US011957158B2

(12) United States Patent
Grigsby

(10) Patent No.: US 11,957,158 B2
(45) Date of Patent: Apr. 16, 2024

(54) MODULAR SMOKABLE PRODUCT PACKAGING SYSTEM AND METHOD

(71) Applicant: KüngTech LLC, Milpitas, CA (US)

(72) Inventor: Eric Grigsby, Las Vegas, NV (US)

(73) Assignee: KüngTech LLC, Milpitas, CA (US)

( * ) Notice: Subject to any disclaimer, the term of this patent is extended or adjusted under 35 U.S.C. 154(b) by 352 days.

(21) Appl. No.: 17/190,005

(22) Filed: Mar. 2, 2021

(65) Prior Publication Data

US 2021/0267264 A1 Sep. 2, 2021

Related U.S. Application Data

(60) Provisional application No. 62/984,292, filed on Mar. 2, 2020.

(51) Int. Cl.

| | |
|---|---|
| ***A24C 5/02*** | (2006.01) |
| ***A24C 5/39*** | (2006.01) |
| ***A24D 1/18*** | (2006.01) |

(52) U.S. Cl.

CPC ..... *A24C 5/02* (2013.01); *A24C 5/39* (2013.01); *A24D 1/18* (2013.01)

(58) Field of Classification Search

None

See application file for complete search history.

*Primary Examiner* — Phu H Nguyen

(74) *Attorney, Agent, or Firm* — Pillsbury Winthrop Shaw Pittman LLP

(57) ABSTRACT

A modular centrifuge apparatus for use in preparing and packing ready-made smokable products is disclosed including a drive assembly with a motor and a drive shaft rotatably coupled to the motor, the drive shaft defining a vertical direction, an axial direction, and a radial direction. The drive shaft extends along the vertical direction out of the motor. A sandwich hub having a notched portion is coupled to the drive shaft. The initiation of the motor rotates the drive shaft assembly along the axial direction. Each of a plurality of dynamic positioning talon assemblies includes a talon frame member and a binary linkage. Each talon frame member is fixedly attached to the sandwich hub using the notched portion and an upper plate, and extends outwardly therefrom along the radial direction. Each talon frame member includes at least one guide slot and at least one alignment post. The binary linkage is slidably coupled to the at least one guide slot of the talon frame member. The binary linkage is configured to move from a first position to a second position along a path defined by the at least one guide slot wherein said path extends greater than 90 degrees to the drive shaft. A plurality of pod assemblies, each including a pod that holds a plurality of zoning funnels, and is configured to move from the first position to the second position along the path defined by the vertical guide slot in response to rotational movement by the drive assembly in the axial direction.

14 Claims, 14 Drawing Sheets

MODULAR SMOKABLE PRODUCT PACKAGING SYSTEM AND METHOD

CROSS REFERENCE TO RELATED APPLICATIONS

This application claims priority to U.S. Provisional Application No. 62/984,292 entitled "MODULAR SMOKABLE PRODUCT PACKAGING SYSTEM AND METHOD" filed on Mar. 2, 2020, which application is expressly incorporated by reference herein.

BACKGROUND

Increasing legalization of cannabinoids and products containing *cannabis* for medical and recreational use for the delivery of THC (Δ9-tetrahydrocannabinol), CBD (cannabidiol), and other cannabinoids has given rise to medical and recreational dispensaries that offer such products. Smoking *cannabis* is the most common, effective, and least expensive method for delivering a pharmacological action to the human brain and body. One convenient method for smoking *cannabis* is to hand-roll loose *cannabis* stock into a cigarette. Prior to the widespread legalization of *cannabis*, consumers typically prepared their own smokable *cannabis* products by hand-rolling loose *cannabis* stock—or blends of *cannabis* with other smokable herbs such as tobacco—into a cigarette or 'joint'. As legalized and regulated commercial markets for medical and recreational *cannabis* products have emerged, demand for ready-made smokable products containing *cannabis* has significantly increased.

The physical properties of *cannabis* differ significantly from tobacco and other smokable herbs. As a result, existing commercial scale technologies used in the ready-made smokable tobacco industry are not effective or efficient for measuring, preparing, and packaging ready-made smokable products containing *cannabis*. For example, secretory glands called trichomes on *cannabis* flower produce a resin containing cannabinoids such as Tetrahydrocannabinol (THC) and cannabidiol (CBD), and terpenes such as myrcene and pinene. When produced in sufficient therapeutic quantities, the resin makes smokable *cannabis* flowers sticky. Smokable tobacco does not have the same adhesive properties and can therefore be injected into empty pre-rolled cigarettes, compressed to the right density to produce an even pack throughout the cigarette. Smokable *cannabis* flowers, however, stick to traditional tobacco packaging machinery, making them inefficient and causing them to malfunction when used to package ready-made smokable products containing *cannabis*. Furthermore, smokable *cannabis* flower tends to stick to the inner surfaces of pre-rolled paper cones as it is injected into the cones, making it difficult to obtain the desired even packing density throughout a ready-made smokable product containing *cannabis* using traditional tobacco packaging machinery.

Various strains of *cannabis* have varying consistencies, potencies, densities, moistures, and degrees of stickiness. As a result of such variations in *cannabis* strains and the differing preferences of consumers, commercial sellers require the ability to make a wide variety of sizes and potencies of ready-made smokable products containing *cannabis*.

Currently, vibratory machines are the industry standard for packaging ready-made smokable products containing *cannabis*. Once measured, a quantity of smokable herb is spread over a surface and into a plurality of article cones, making it difficult to ensure consistent amount of smokable herb is deposited into each article cone. The machine then vibrates the article cones to help settle the loose smokable herb mixture within the article cones and to remove air pockets. Once the article cones are filled and vibrated, the contents of each article cone must then be tamped down by hand to make sure each is adequately compressed or packed, and to remove additional air pockets that form as a result of the stickiness of the smokable herb mix including *cannabis*. Vibratory machines also naturally cause an uneven distribution of smokable herb particles throughout ready-made smokable products, as smaller particulates move more easily and become unevenly concentrated at one end of the ready-made smokable products. Further, currently existing technologies for packaging ready-made smokable products containing *cannabis* suffer from an inability to measure and package a given volume or weight of smokable herb within each joint with any accuracy or consistency.

Thus, there is a need for a system and method to efficiently, accurately, and consistently measure and fill commercially viable quantities of article cones with smokable herb as well as uniformly compress and package ready-made smokable products.

The disclosed system and method are directed to overcoming one or more of the problems set forth above and/or other problems of the prior art.

SUMMARY

In one aspect, the present disclosure is directed to a modular centrifuge system for preparing and packing ready-made smokable herb products, including a drive assembly comprising, which includes a motor; a drive shaft rotatably coupled to the motor, the drive shaft defining a vertical direction, an axial direction, and a radial direction, the drive shaft extending along the vertical direction out of the motor; and a sandwich hub coupled to the drive shaft, the sandwich hub including a portion with a plurality of notched surfaces; wherein initiation of the motor rotates the drive shaft assembly along the axial direction; and a plurality of dynamic positioning talon assemblies, each dynamic positioning talon assembly comprising a talon frame member and a binary linkage, the talon frame member having an end that fits into one of the plurality of notched surfaces and including at least one guide slot and at least two alignment posts and being fixedly attached to the sandwich hub using the at least two alignment posts and an upper portion and extending outwardly therefrom along the radial direction, the binary linkage being slidably coupled to the at least one guide slot of the talon frame member and being configured to move from a first position to a second position along a path defined by the at least one guide slot wherein said path extends greater than 90 degrees to the drive shaft; and a plurality of pod assemblies, each pod assembly comprising a pod including a plurality of zoning funnels, each of the plurality of pod assemblies being detachably coupled to a respective binary linkage; wherein each pod is configured to move from the first position to the second position along the path defined by the at least one guide slot in response to rotational movement of the drive assembly in the axial direction.

In another aspect, the present disclosure is directed to a method of preparing and packing ready-made smokable herb products, the method including loading smokable herb into a plurality of article cones disposed within zoning funnels for each of a plurality of pod assemblies, each of the plurality of pod assemblies being detachably coupled to a respective binary linkage of a talon frame member; initiating a motor coupled to a drive shaft, the drive shaft extending along a vertical direction out of the motor and coupled to a sandwich hub, the sandwich hub being coupled to a plurality of talon frame members; rotating the drive shaft in an axial direction in response to the motor being initiated, causing the sandwich hub and the plurality of talon frame members to axially rotate; and moving the plurality of pod assemblies from a first position to a second position along a path defined by a respective guide slot of each respective talon frame member in response to the axial rotation of the plurality of talon frame members.

In yet another aspect, the present disclosure is directed to a system for preparing and packing ready-made smokable herb products including a control unit coupled to a centrifuge, which includes a drive assembly; a motor; a drive shaft rotatably coupled to the motor, the drive shaft defining a vertical direction, an axial direction, and a radial direction, the drive shaft extending along the vertical direction out of the motor; and a sandwich hub coupled to the drive shaft, the sandwich hub including a portion with a plurality of notched surfaces; wherein initiation of the motor rotates the drive shaft assembly along the axial direction; and a plurality of dynamic positioning talon assemblies, each dynamic positioning talon assembly comprising a talon frame member and a binary linkage, the talon frame member abutting one of the plurality of notched surfaces and including at least one guide slot and one or more alignment posts and being fixedly attached to the sandwich hub using the one or more alignment posts and an upper portion and extending outwardly therefrom along the radial direction, the binary linkage being slidably coupled to the at least one guide slot of the talon frame member and being configured to move from a first position to a second position along a path defined by the at least one guide slot wherein said path extends greater than 90 degrees to the drive shaft; and a plurality of pod assemblies, each pod assembly comprising a pod including a plurality of zoning funnels, each of the plurality of pod assemblies being detachably coupled to a respective binary linkage; wherein each pod is configured to move from the first position to the second position along the path defined by the at least one guide slot in response to rotational movement of the drive assembly in the axial direction, the control unit being configured to initiate the motor coupled to the drive shaft causing the drive shaft to rotate along the axial direction; monitor via sensors within the centrifuge, the rotational speed of the drive shaft; and disengage the motor coupled to the drive shaft.

BRIEF DESCRIPTION OF THE SEVERAL VIEWS OF THE DRAWINGS

To easily identify the discussion of any particular element or act, the most significant digit or digits in a reference number refer to the figure number in which that element is most prominently illustrated and discussed.

The disclosure will be readily understood by the following detailed description in conjunction with the accompanying drawings, wherein like reference numerals designate like structural elements, and wherein letters (e.g., V, R, A, etc.) designate like axes, planes, and/or directions, and in which:

FIG. 6A is a profile view illustration of a disclosed example of a pod that may be used with the pod assembly depicted in FIG. 3;

FIG. 6B is a top-down illustration of a disclosed example of a pod that may be used with the pod assembly depicted in FIG. 3;

FIG. 6C is a cross-sectional illustration of a disclosed example of a pod, including zoning funnels, which may be used with the pod assembly depicted in FIG. 3;

FIG. 6D is an isometric illustration of a disclosed example pod that may be used with the pod assembly depicted in FIG. 3;

DETAILED DESCRIPTION

The present disclosure is directed to a system and method for packaging ready-made smokable products and, more particularly, to a modular centrifuge system and method for measuring, loading, and packing ready-made smokable products.

Figure 1A:
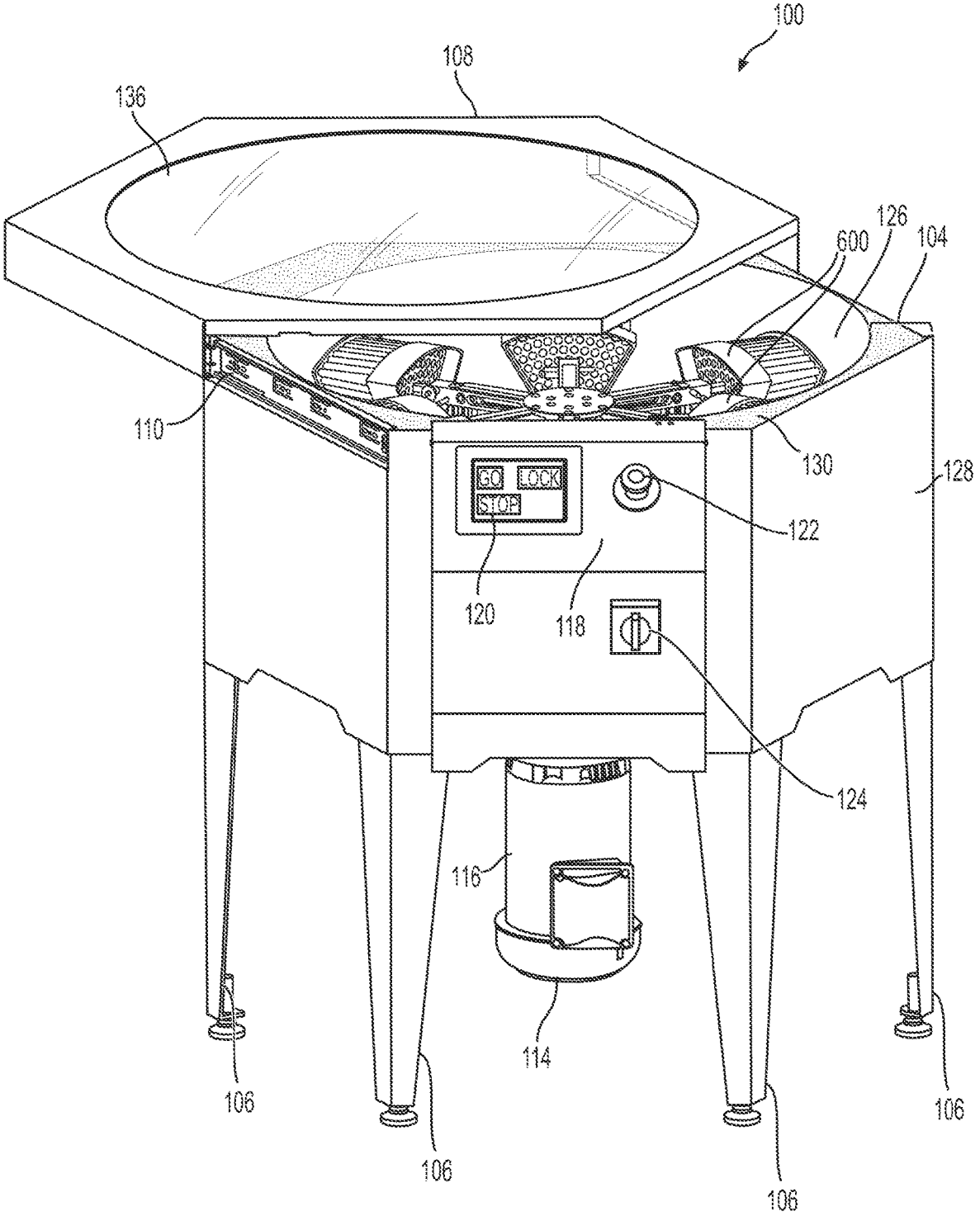
FIG. 1A is an isometric illustration of a disclosed example of a modular smokable-product packaging centrifuge.
Figure 1B:
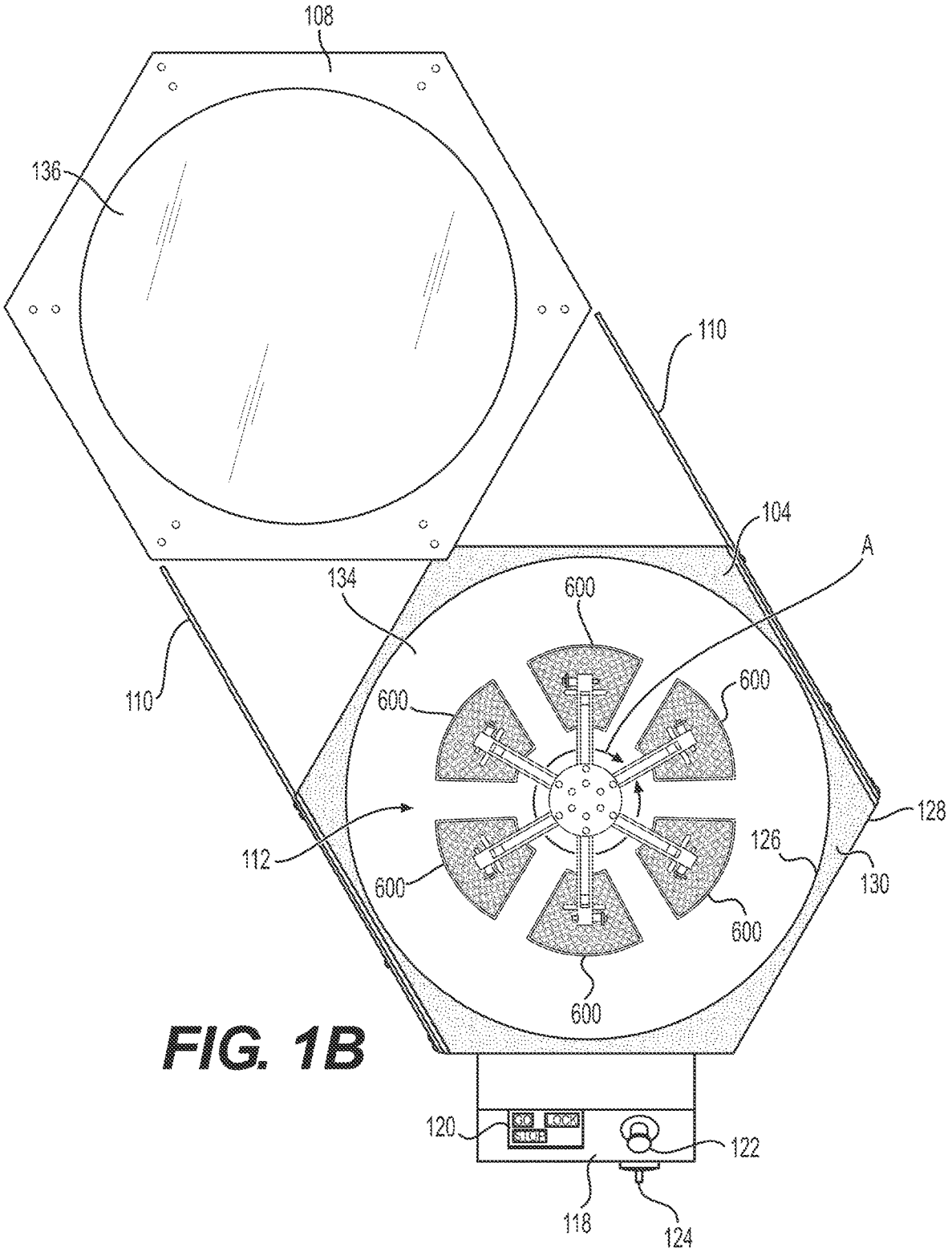
FIG. 1B is a plan-view illustration of a disclosed example of a modular smokable-product packaging centrifuge.

FIG. 1A is an isometric illustration of a modular smokable-product packaging centrifuge system 100 according to an implementation of the present disclosure. In some embodiments, modular smokable-product packaging centrifuge 100 includes a housing side wall 104; centrifuge 112; cooling fan 114; motor 116; a control unit 118 including a graphical user interface (GUI) 120, activation switch 122, and power switch 124; and a plurality of pods 600. FIG. 1B is a plan-view illustration of modular smokable-product packaging centrifuge system 100 and includes housing wall 104, inner wall 126, outer wall 128, and cabinet 134.

In some embodiments, a housing of modular smokable-product packaging centrifuge system 100 comprises housing side wall 104, removable housing lid 108, housing base 202 (shown in FIG. 2A), and legs 106. In some embodiments housing side wall 104 comprises an inner wall 126, an outer wall 128, and an interior wall material 130. Housing side wall 104 may include an inner wall 126, an outer wall 128, and an interior wall material 130. Inner wall 126 and outer wall 128 may be composed of lightweight shapeable materials such as stainless-steel sheeting. Inner wall 126 may form a vertical cylinder shape with a height and radius large enough to form a cabinet 134 of sufficient size to allow the components of centrifuge 112 located within housing side wall 104 to operate and move without contacting inner wall 126, and to allow sufficient space for an operator to access centrifuge 112 in order to attach and remove pod 600. The lateral shape of outer wall 128 may form a shape that provides stability to the apparatus during operation of centrifuge 112, such as, for example, a hexagonal shape, as illustrated in the disclosed example embodiment of FIGS. 1A-B. Further, outer wall 128 may form a vertical column having a height substantially equivalent to the height of inner wall 126, and may have a lateral area larger than the lateral area formed by inner wall 126, thus creating a void between the surfaces of inner wall 126 and outer wall 128. In some embodiments, the void between the surfaces of inner wall 126 and outer wall 128 may be filled with one or more relatively light-weight interior wall material(s) 130 that increase the rigidity, impact resistance, acoustic insulation, and/or physical-vibration damping attributes of housing side wall 104. Further, housing side wall may be composed of materials sufficient to provide impact resistance in order to prevent injury or damage due to escaping debris and/or components of malfunctioning or improperly installed/maintained centrifuge 112. In some examples, interior wall material 130 may include a sprayable, pourable, or injectable expanding foam that includes resins such as urethane, polyurethane, ABS, HDPE, polycarbonate, nylon, and/or polystyrene. In some examples, foam "X30" may be used. In some examples, housing side wall 104 further includes a housing base 202 (shown in FIG. 2A). In some examples, a plurality of legs 106 may support housing side wall 104 and centrifuge 112. For example, the embodiment illustrated in FIG. 1 includes six legs 106. Legs 106 may be configured, either individually or in combination, to allow adjustment in order to level and stabilize modular smokable-product packaging centrifuge system 100, including during operation.

In some examples, the housing of modular smokable-product packaging centrifuge system 100 includes removable housing lid 108, which may be operably moved to substantially cover the entire lateral area formed by the upper edge of outer wall 128, and may be move along carriage assembly 110, which may be attached to housing side wall 104. For example, in one embodiment carriage assembly 110 may include one or more slidable pieces, such as drawer slides, attached to the upper surface of housing wall 132. In some embodiments, carriage assembly 110 may further include slidable pieces attached to two parallel sides of outer wall 128.

According to some embodiments, removable housing lid 108 and carriage assembly 110 may be configured to allow removable housing lid 108 to be moved between a closed position substantially covering the entire upper edge of housing wall 132, and an open position in which removable housing lid 108 is substantially removed from covering cabinet 134, and, in some examples, any position in between.

According to some embodiments, removable housing lid 108 includes a viewing portal 136 through which the operations of centrifuge 112 are observable. In some examples, viewing portal 136 may be composed of translucent, lightweight, and impact-resistant material such as smoked polycarbonate.

In some embodiments, housing base 202 (shown in FIG. 2A) may be attached to the lower edges of inner wall 126 and outer wall 128, substantially covering cabinet 134 and the lower edges of housing wall 104.

In some embodiments, centrifuge 112 may include a motor 116 and a cooling fan 114 fixably connected to a bottom surface of housing base 202. As discussed in greater detail below with respect to FIG. 2A, motor 116 is operably connected to drive shaft 212, which extends through an aperture (not shown) in housing base 202 (shown in FIG. 2A). In some embodiments, motor 116 may be configured to rotate a drive shaft 212 about a central axis of rotation by rotating a balanced configuration of a plurality of pods 600, each pod 600 containing one or more article cones 308 filled with smokable herb 310 (shown in FIG. 3), thereby generating a packing force sufficient to uniformly compress smokable herb 310 within each article cone 308. In some examples, motor 116 may be capable of rotating the moving parts of centrifuge 112 at operational speeds between 1,000-3,000 RPM. In some embodiments, operational speed may be selected by an operator, or may be automatically determined depending on the physical properties of the smokable herb 310, such example physical properties including the volume and weight of smokable herb 310 deposited in each article cone 308, the moisture of the smokable herb 310 deposited in each article cone 308, the unpacked density of the smokable herb 310 deposited in each article cone 308, the stickiness of the smokable herb 310 deposited in each article cone 308, and the desired density of ready-made smokable products being prepared. In some embodiments, centrifuge 112 may operate at a top speed of approximately 1,700 RPM. In some examples, centrifuge 112 may operate with a maximum speed between 1,000-3,000 RPM.

In some embodiments, cooling fan 114 may be a low voltage fan intended to regulate the temperature of motor 116. In some examples, cooling fan 114 may be a 2HP AC cooling fan. In some examples, cooling fan 114 may be located beneath motor 116.

In some embodiments, a control unit 118 may be attached to outer wall 128 and may be configured to enable an operator to program, monitor, and operate modular smokable-product packaging centrifuge system 100. In another embodiment, control unit 118 may be located in other positions on centrifuge 112, or may be located in a separate location remote to modular smokable-product packaging centrifuge system 100 and may be configured to communicate with centrifuge 112 via wired or wireless means.

According to some embodiments, control unit 118 may include a graphical user interface (GUI) 120 to allow a user to enter information, control centrifuge 112 and removable housing lid 108, to monitor operations of modular smokable-product packaging centrifuge system 102, and monitor and control operations of centrifuge 112. In some examples, GUI 120 may include an electronic display such as, for example, an active matrix emitting diode (AMOLED), light-emitting diode (LED), organic LED (OLED), electrophoretic, liquid crystal, e-paper, and/or the like and/or combinations thereof. In some examples, GUI 120 may include an input device such as an HMI Touch Screen or keyboard. In some examples, GUI 120 may be displayed on the electronic display, and may directly or indirectly control one or more aspects of operation of centrifuge 112, such as spin duration and maximum operational speed of a packing operation of modular smokable-product packaging centrifuge system 100. By way of example, GUI 120 may be configured to directly receive input of a spin duration parameter and a maximum operational speed parameter. Alternatively, GUI 120 may be configured to receive input of parameters from which the spin duration and maximum operational speed may be determined. For example, GUI 120 may be configured to accept inputs identifying one or more pod configurations, desired packing densities, etc., or by receiving input from one or more sensors before or during operation of centrifuge 112 to monitor components of centrifuge 112 depending on desired factors and attributes of smokable herb 310 being packed. In still another example, GUI 120 may be configured to receive input to initiate and/or stop operation of centrifuge 112.

In some embodiments, control unit 118 may further include one or more sensors (not shown), an emergency shut off switch 122, a power switch 124, and a failsafe lock (not shown) discussed in greater detail below.

In some embodiments, control unit 118 may include one or more processors, central processing units (CPUs), graphical processing units (GPUs), virtual machines, microprocessors, microcontrollers, logic circuits, hardware finite state machines (FSMs), digital signal processors (DSPs) application specific integrated circuits (ASICs), field programmable gate arrays (FPGAs), and/or the like and/or combinations thereof. In some examples, memory may be used to store one or more applications and one or more data structures. In some examples, memory may each include one or more types of machine-readable media, including volatile and non-volatile memory. Some common forms of machine-readable media may include floppy disk, flexible disk, hard disk, magnetic tape, any other magnetic medium, CD-ROM, any other optical medium, punch cards, paper tape, any other physical medium with patterns of holes, ROM, PROM, EPROM, FLASH-EPROM, any other memory chip or cartridge, and/or any other medium from which a processor or computer is adapted to read. Some common forms of volatile memory include SRAM, DRAM, IRAM, and/or any other type of medium which retains its data while devices are powered, potentially losing the memory when the devices are not powered.

One or more operation controllers may be configured to operate remotely. In some examples, one or more computing devices, including control unit 118 may be coupled to one or more operation controllers using a network. In some examples, computing devices may be connected via any type of wired or wireless connections, such as dedicated short-range communications (DSRC), satellite, fire wire, network, USB, Wi-Fi, radio-frequency identification (RFID), BLUETOOTH, GPS, Near Field Communication (NFC), Infrared (e.g., GSM infrared), and/or the like and/or using any suitable wireless communication standards and protocols, such as IEEE 802.11 and WiMAX. A network, including any intervening nodes, may be any kind of network including a local area network (LAN) such as an Ethernet, a wide area network (WAN) such as an internet, a virtual or non-virtual private network, and/or the like and/or combinations thereof.

In some embodiments, the network may include any type of computing device including personal computers (e.g., laptop, desktop, smartphone, or tablet computers), servers (e.g., web servers, database servers), network switching devices (e.g., switches, routers, hubs, bridges), or mobile communication devices (e.g., mobile phones, portable computing devices), and/or the like, and may include some or all of the elements previously mentioned. In some examples, computing devices may include various input and output (I/O) devices, such as a keyboard, a mouse, touchscreen, button inputs, microphone, motion sensor, eye sensor, video display, and/or the like.

In some embodiments, control unit 118 may be configured to receive signals from one or more sensors (not shown), such as a pressure sensor, optical sensor, encoded magnetic sensors, and/or the like and/or combinations thereof, configured to indicate whether removable housing lid 108 is in a closed position or an open position. For example, sensors such as encoded magnetic sensors may form an interlock comprising a first sensor located at one end of removable housing lid 108 being configured to engage with a second sensor located along inner wall 126 to generate a signal when the sensors are in contact, indicating that removable housing lid 108 is in a closed position. When engaged, the interlock may be used to lock removable housing lid 108 in a closed position throughout the duration of a packing operation. In some examples, control unit 118 may be configured to prevent the initiation of a packing operation until removable housing lid 108 is in a closed position. Upon receiving instructions to initiate a packing operation, control unit 118 may monitor the sensors, and may automatically lock removable housing lid 108 in the closed position, and may then send signals to centrifuge 112 to commence a packing operation. Once control unit 118 determines that a packing operation is complete and that centrifuge 112 is no longer moving, control unit 118 may unlock removable housing lid 108. Removable housing lid 108 may be attached to housing side wall. In some examples, removable housing lid 108 may be operably attached as shown in the example embodiment of FIGS. 1A and 1B such that a carriage assembly 110 may be fixedly attached to an inner surface of a vertical portion of removable housing lid 108. In some embodiments, two or more carriage assemblies 110 may be attached to parallel surfaces of removable housing lid 108. For example, a first portion of carriage assemblies 110 may then be slidably attached to a second portion of carriage assembly 110 mounted along upper surfaces of parallel housing side wall 104. It is understood that removable housing lid 108 may alternatively be moved to cover or uncover centrifuge 112 and/or cabinet 134 by other known methods. For example, removable housing lid 108 may be free standing, or may be pivotably attached to housing side wall 104.

In some examples, control unit 118 may be configured to receive signals from one or more vibration sensors (not shown), such as an automation vibration sensor, condition sensor, and/or the like, and/or combinations thereof. In some examples, during operation of centrifuge 112, vibration sensor(s) such as, for example IFM sensors, may sense vibrations exceeding a predetermined or calculated threshold level indicative of system, component, and/or load imbalance, misalignment, and resonances that may result in unsafe or damaging operational conditions of any portion of system 100. Some advantages of disclosed embodiments include increased stability of operation of centrifuge 112, reduced risk of damage that may arise from dislodging parts of centrifuge 112, reduced waste of product, safer conditions of operation, increased longevity of centrifuge 112, etc. In one example, a plurality of pods 600 may be loaded into centrifuge 112 as discussed further below with respect to FIGS. 3 and 4B, and one or more vibrational sensor(s) may be configured to detect vibrations during operation of centrifuge 112 resulting from improper or unbalanced loading pods within centrifuge 112 as discussed in greater detail with respect to FIGS. 5A-5D, or from an imbalance of article cones 308 and/or smokable herb 310 deposited and arranged among pods 600. The vibrational sensor(s) may detect vibrations of centrifuge 112 exceeding the predetermined threshold, and automatically cease operations or kill power to the motor 116.

Figure 2A:
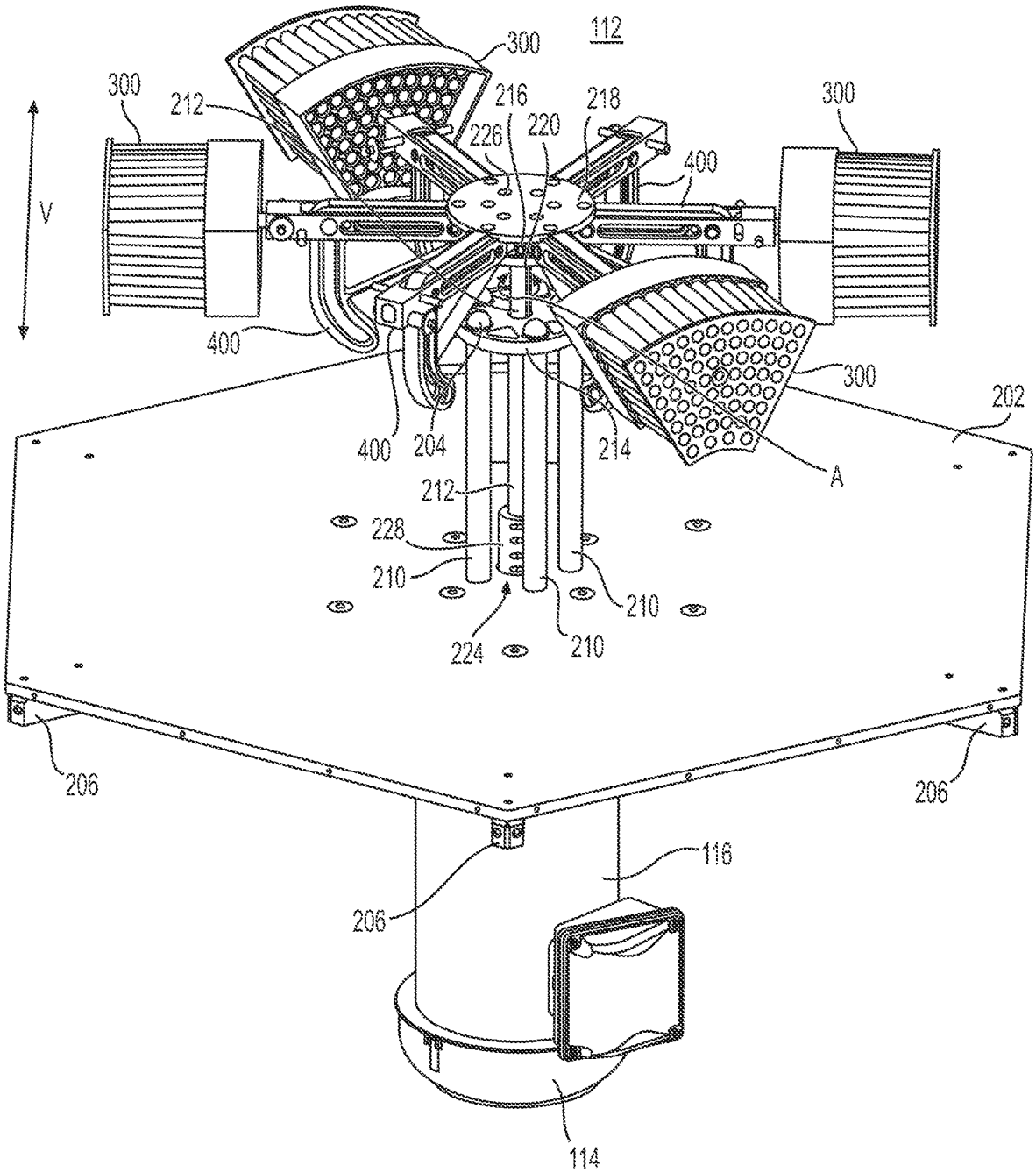
FIG. 2A is an isometric perspective illustration of a disclosed example of the centrifuge system depicted in FIGS. 1A and 1B without housing side walls, control panel, and removable housing lid.

FIG. 2A is an isometric perspective illustration of modular smokable-product packaging centrifuge system 100 depicted in FIGS. 1A and 1B omitting housing side wall 104, removable housing lid 108, and carriage 110 in order to more clearly illustrate centrifuge 112, housing base 202, and a plurality of lateral housing supports 206. In some embodiments, centrifuge 112 comprises a plurality of structural pillars 210, a drive shaft 212, a bearing puck 214, a sandwich hub 216, a plurality of dynamic positioning talon assemblies 400, and a plurality of pod assemblies 300. As discussed above, the housing of system 100 may include housing base 202, and lateral housing supports 206 such as those displayed in FIG. 2A.

Figure 2B:
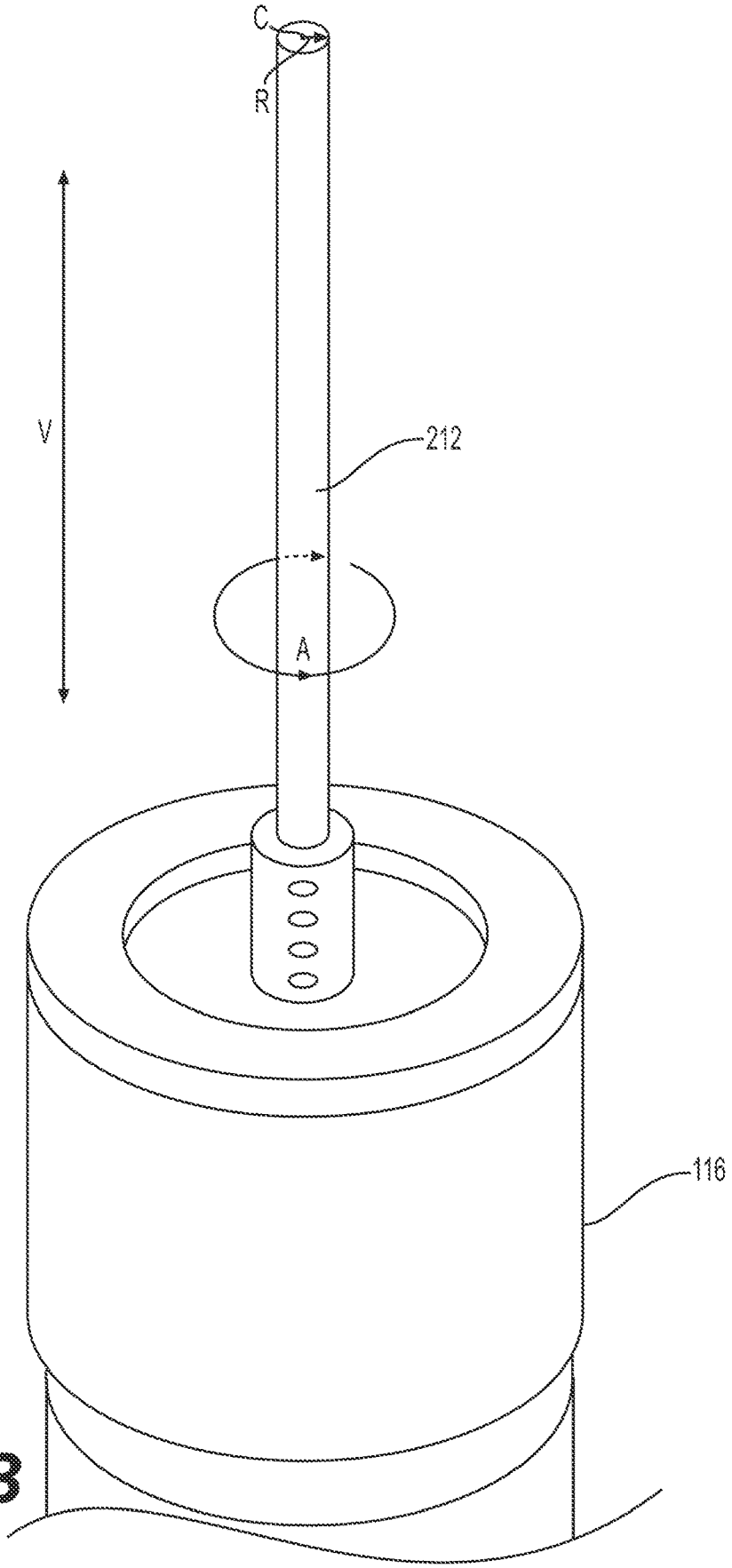
FIG. 2B is an isometric perspective illustration of a motor and drive shaft used with the centrifuge system depicted in FIG. 2A.

FIG. 2B is an isometric perspective illustration of a motor 116 and a drive shaft 212. As shown in FIG. 2B, drive shaft 212 defines a vertical direction V, an axial direction A, and a radial direction R. More particularly, drive shaft 212 extends from motor 116 along the vertical direction V. Drive shaft 212 comprises a rod or cylinder having a radius that extends outward in a radial direction R from the center point C of drive shaft 212. A line tracing the circumference of drive shaft 212 constitutes axial direction A. Returning to FIG. 2A, a plurality of dynamic positioning talon assemblies 400 may be fixably attached to centrifuge 112. As discussed further below with respect to FIG. 3, in some examples, a plurality of pod assemblies 300 may be removably attached to a plurality of dynamic positioning talon assemblies 400 in a balanced configuration.

In some examples, motor 116 generates mechanical output causing drive shaft 212 to rotate about the center point C along a central axis defined by axial direction A. The rotation of drive shaft 212 may cause the components of centrifuge 112 operably attached thereto including dynamic positioning talon assembly 400 and pod assembly 300 to rotate along axial direction A. Components of centrifuge 112 rotating along axial direction A experience one or more rotational/inertial forces.

Dynamic positioning talon assembly 400 includes mechanical kinematic joints such as pin-in-slot joints that allow pod assembly 300 and components of dynamic positioning talon assembly 400 to move in response to rotational/inertial forces imparted by the rotation of drive shaft 212. As discussed further below with respect to FIGS. 4B and 4C, the mechanical kinematic joints of dynamic positioning talon assembly 400 allow movement of pod assembly 300 along one or more degrees of freedom (DoF), and restrict movement of pod assembly 300 in one or more DoF. In the disclosed example illustrated in FIG. 2A, dynamic positioning talon assembly 400 includes a compound joint formed by two pin-in-slot joints to enable movement of pod assembly 300 in two DoF in response to rotational/axial forces it experiences during operation of centrifuge 112. Drive shaft 212 extends along the vertical direction V for a distance sufficient to allow connected pod assembly 300 to move from a loading/unloading position to an operating/rotating position without contacting either housing base 202 or housing side wall 104.

Some advantages of disclosed embodiments include dynamic positioning of pod assemblies 300 during operation of centrifuge 112, which may allow for a substantial compressive force as pod assembly 300 travels between a loading/unloading position and an operating/rotating position, in some examples generating compressive force on article cone 308 and smokable herb 310 within pod assembly 300 of up to 3,000 pounds of force per square inch. This compressive force results in substantially uniform compression of smokable herb 310 within article cone 308, allowing for a more homogeneous and uniform packing of smokable herb 310 throughout ready-made smokable products containing *cannabis* including increased density of smokable herb 310, fewer and smaller air gaps, and the like.

As illustrated in FIG. 1B, centrifuge 112 may be located within a housing comprising housing base 202. Housing base 202 may include aperture 224 through which drive shaft 212 may extend in a vertical direction V. Housing base 202 may extend outward along radial direction R to form a lower inner surface of the housing and may have an area that substantially covers the area of cabinet 134, extending from aperture 224 to housing side wall 104. Housing base 202 may be fixedly attached to a lower portion of housing side wall 104. Aperture 224 may include bearings, rollers, or an adequate friction reducing agent, distributed along its perimeter and configured to contact drive shaft 212 while allowing drive shaft 212 to rotate freely along axial direction A. Alternatively, aperture 224 may have a diameter such that drive shaft 212 does not make contact with aperture 224. In some examples, a coupler 228 may attach drive shaft 212 to motor 116, extending along vertical direction V through aperture 224. As an alternative to an aperture 224, housing base 202 may include a mechanical interface configured to transfer mechanical force from motor 116 to drive shaft 212. Housing base 202 may be composed of material sufficient to provide impact resistance to prevent injury or damage that may be caused by escaping debris and/or components of malfunctioning or improperly installed/maintained centrifuge 112. In some examples, housing base 202 may be composed of stainless-steel plating, rubber, plastic, plexiglass, or a combination thereof having sufficient structural integrity. One or more lateral housing support 206 may be located below a lower surface of housing base 202. Lateral housing support 206 may be fixedly attached to housing base 202 and may provide structural support to housing base 202. Lateral housing support 206 may also provide a surface for mounting legs 106, motor 116, cooling fan 114, and/or other components.

A plurality of structural pillars 210 may be distributed along a geometric perimeter some distance along radial direction R from drive shaft 212 and aperture 224. Each of structural pillar 210 may be mounted to housing base 202, and may extend from housing base 202 along a vertical direction V. In some examples, the lower proximal end of each pillar may include a threaded rod portion which may be secured to threaded rod holes located on housing base 202. In some examples, methods of mounting each structural pillar 210 to housing base 202 may alternatively include welding, bonding, and/or the like. In some examples, the upper distal end of each structural pillar 210 may be fixedly attached to a bearing puck 214. In the example embodiment illustrated in FIG. 2A, each structural pillar 210 is attached to bearing puck 214 and secured thereto by a nut 204. In some embodiments, bearing puck 214 may extend outward from drive shaft 212 along radial direction R. In some examples, the plurality of structural pillars 210 may extend along vertical direction V through apertures in bearing puck 214.

In some embodiments, each structural pillar 210 may comprise an inner layer composed of steel and an outer layer composed of carbon fiber. Some advantages of the dual layered structural pillar 210 includes increased stability and durability. Carbon fiber tends to be fragile under pressure causing it to crack or fracture. Stainless steel, however, is somewhat flexible or malleable under pressure. When carbon fiber is layered over the stainless steel to form structural pillar 210, results in a structural pillar 210 having both increased stability and strength in addition to a reducing the tendency of structural pillar 210 to crack or bend.

Advantageously, the plurality of structural pillars 210 and bearing puck 214 may be configured to impart structural support and stability to drive shaft 212 sufficient to maintain the vertical alignment of drive shaft 212 during the operation of centrifuge 112. More particularly, drive shaft 212 may extend along vertical direction V through an aperture in bearing puck 214. The aperture in bearing puck 214 may include ball bearings, rollers, or other components distributed along the perimeter of the aperture and configured to contact drive shaft 212 while also allowing drive shaft 212 to rotate freely or nearly freely along the axial direction A.

FIG. 2A illustrates centrifuge 112, including a plurality of pod assemblies 300 in an operating/rotating position. Specifically, when pod assembly 300 is in an operating/rotating position, pod rod 302 and zoning funnels 606 of pod 600 may be oriented at an angle of approximately 0.1-95 or more degrees with respect to vertical direction V. In some examples, pod rod 302 and zoning funnels 606 of pod 600 may be oriented at an angle substantially normal to vertical direction V. By contrast, when pod assembly 300 is in a loading/unloading position, pod rod 302 and zoning funnels 606 of pod 600 are oriented vertically, at an angle substantially horizontal to vertical direction V, such that smokable herb deposited into tray 602 falls vertically along vertical direction V into zoning funnels 606. As discussed in greater detail below, FIG. 4B similarly illustrates pod assembly 300 in a loading/unloading position and FIG. 4C illustrates pod assembly 300 in an operating/rotating position.

Figure 2C:
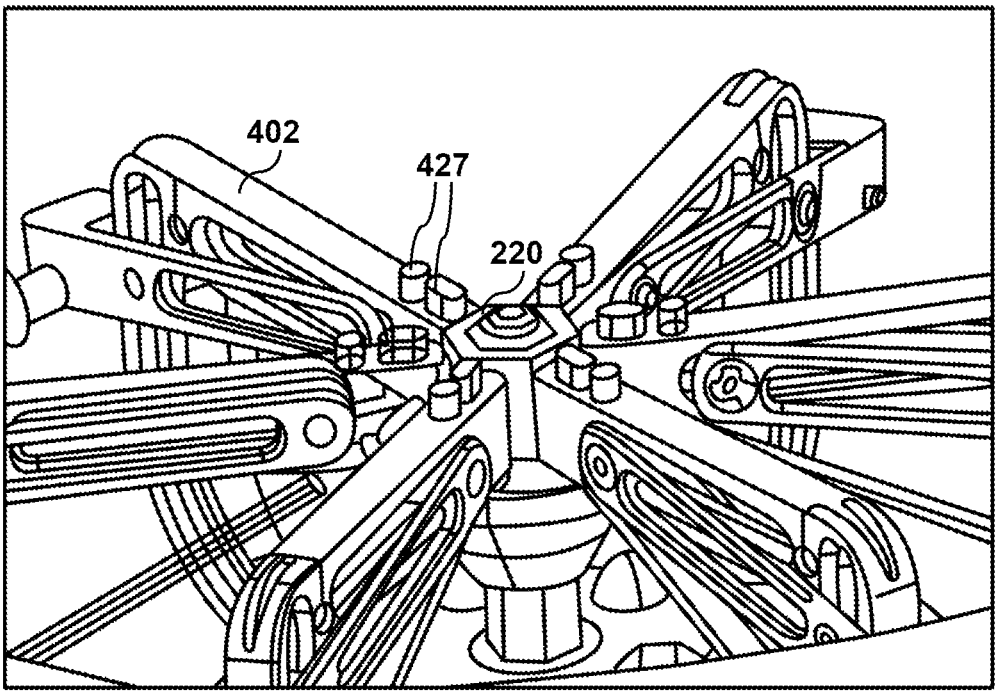
FIG. 2C is a perspective view of the sandwich hub with the upper portion top plate removed.
Figure 2D:
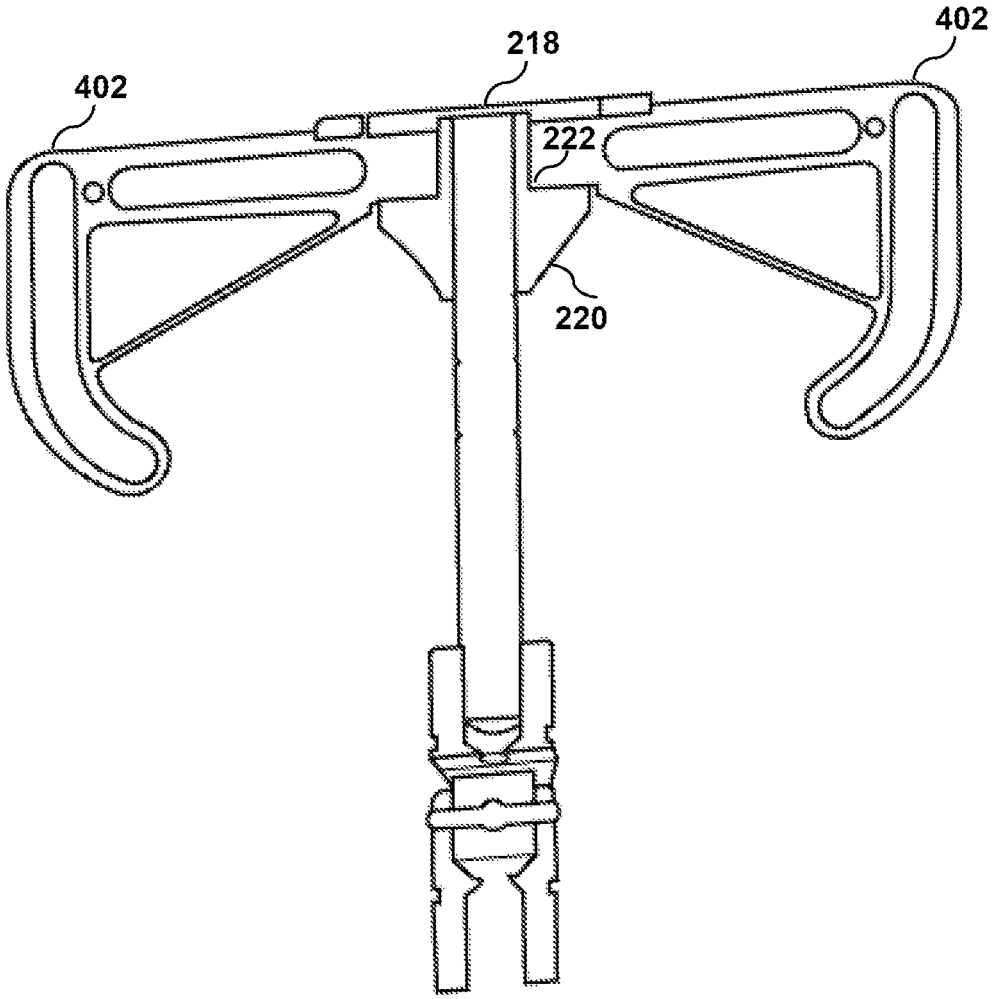
FIG. 2D is a cross section of the sandwich hub.

A plurality of dynamic positioning talon assemblies 400 may be attached to an upper end of drive shaft 212 extending outwardly from drive shaft 212 along radial direction R. Dynamic positioning talon assembly 400 may further be distributed about drive shaft 212 along axial direction A. In the example illustrated in FIG. 2A, a plurality of talon frame members 402 are attached to drive shaft 212 via a sandwich hub 216, which is fixedly attached to an upper end of drive shaft 212. Sandwich hub 216 may comprise an upper portion 218 and a portion 220 that is shown in further detail in FIGS. 2C and 2D, with FIG. 2C showing the sandwich hub with the upper portion 218 removed, and the FIG. 2D showing a cross-section, as well as illustrating the inclusion of a U-joint within the drive shaft 212 to assist with vibration damping. The portion 220 of the sandwich hub 216 has a plurality of notched portions 222 against which abut an end of surface 424 of talon 402, each extending along radial direction R from drive shaft 212, each being configured to receive the plurality of dynamic positioning talon assemblies 400. A hex shape for the vertical surfaces of the notched portions 222 is illustrated for an embodiment with six talons 402 being attached to the sandwich hub 216. Each dynamic positioning talon assembly 400 may be positioned proximate to sandwich hub 216 and may extend therefrom along radial direction R. Sandwich hub 216 may be configured to mechanically attach to and retain dynamic positioning talon assemblies 400. For example, one or more screws 226 may be used to attach upper portion 218 and/or lower portion 220 to dynamic positioning talon assembly 400; or alternatively one or more alignment posts 427 that align with holes in the upper portion or plate 218, which upper plate 218 is fixed in place as part of the sandwich hub with a center bolt. Upper portion 218 and portion 220 may each include a plurality of channels configured to receive a portion of dynamic positioning talon assembly 400 such as to prevent unwanted movement and/or rotation of dynamic positioning talon assembly 400 within sandwich hub 216.

Figure 3:
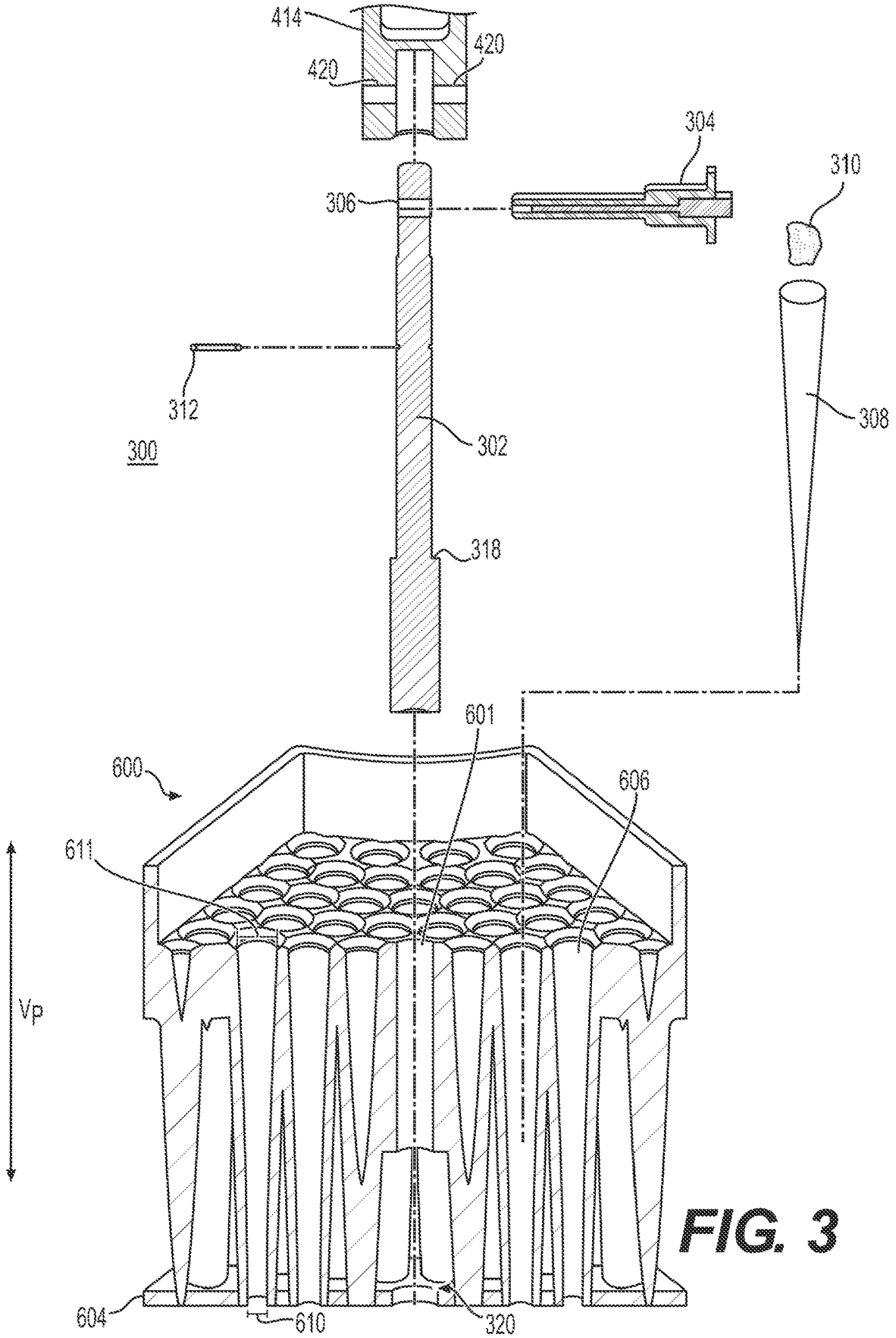
FIG. 3 is an exploded cross-sectional illustration of a disclosed example of a pod assembly for the centrifuge system depicted in FIGS. 2A-D as well as a connecting portion of a binary linkage, article cone, and smokable herb.

FIG. 3 is an exploded cross-sectional illustration of a pod assembly 300 according to an implementation of the present disclosure. The illustrated pod assembly 300 comprises pod 600, pod rod 302, push-ball pin 302, and fastener 312. FIG. 3 further illustrates an article cone 308, smokable herb 310, and a cross-section of a portion of binary linkage 414, which is discussed in greater detail in relation to FIGS. 4A, 4B, and 4C. Zoning funnels 606 define a vertical direction $V_P$. More specifically, pod 600 includes a plurality of zoning funnels 606 that each extend the height of pod 600 along vertical direction $V_P$.

In some examples of one disclosed embodiment illustrated in FIG. 3, pod 600 contains at least one article cone 308 filled with a smokable herb 310 and may be attached to dynamic positioning talon assembly 400 using a pod rod 302. Pod rod 302 may be a rod-like body or other elongated member configured to removably attach pod 600 to binary linkage 414 of dynamic positioning talon assembly 400. Pod rod 302 may be secured at or near a proximal end to pod 600 and at or near a distal end to binary linkage 414 of dynamic positioning talon assembly 400. Advantageously, pod rod 302 may be attached through the center of pod 600 so as to allow for increased stability and reduced component fatigue during operation of centrifuge 112.

In the example embodiment shown in FIG. 3, pod rod aperture 601 forms a hole located near the center of pod 600 extending the height of pod 600 along vertical direction $V_P$ and being configured to receive pod rod 302. Pod rod aperture 601 may be positioned within pod 600 such that the weight and orientation of pod 600 is evenly distributed, or otherwise advantageously distributed about the axis of pod rod 302. Pod rod 302 should be of a thickness and diameter such that it is capable of withstanding forces and stresses generated throughout operation of centrifuge 112, and also to reduce or eliminate mechanical fatigue to pod rod 302 and other components of centrifuge 112.

As shown in FIG. 3, pod rod aperture 601 may further include a counterbore 320, thereby allowing the lower portion of pod rod 302 to be recessed within pod 600, which allows pod 600 to be stably placed on a flat work surfaces in order to load article cone 308 filled with a smokable herb 310 into zoning funnels 606 of pod 600, and to remove ready-made smokable products from pod 600 after being packed during an operation of system 100.

In the example embodiment shown in FIG. 3, pod rod 302 may include an annular projection 318 located near the proximal end of pod rod 302 extending radially therefrom beyond the circumference of pod rod 302 to form a shoulder or flange. In some examples of one disclosed embodiment illustrated in FIG. 3, pod rod aperture 601 may also include a counterbore 320 along bottom surface 604 of pod 600. Counterbore 320 may be substantially concentric with pod rod aperture 601, said counterbore 320 having a diameter large enough to accept the annular projection 318. Counterbore 320 may further have a depth such that pod rod 302 may be recessed below bottom surface 604 such that pod rod 302 does not protrude substantially below bottom surface 604. Annular projection 318 may have a diameter that is less than the diameter of counterbore 320, but greater than the diameter of pod rod aperture 601 such that the shoulder or flange of annular projection 318 may be inserted through pod rod aperture 601 and may be removably affixed to pod 600 by contact of annular projection 318 at the intersection of counterbore 320 and pod rod aperture 601.

In some examples of one disclosed embodiment illustrated in FIG. 3, pod rod 302 may be coupled to pod 600 using a fastener 312 such as a retaining ring, collar, or slotted washer which may be removably fastened to pod rod 302 to prevent or reduce movement of pod 600 along pod rod 302 during operation of modular smokable-product packaging centrifuge system 100. Once fastened to the shaft of pod rod 302, fastener 312 may extend annularly beyond the circumference of pod rod 302. In some alternative examples, pod rod 302 could include a threaded rod with locking components may be used to attach pod rod 302 to pod 600.

Some advantages of disclosed embodiments include mitigating undesirable effects during operation of centrifuge 112 such as excessive vibration, unintentional release, or movement of pod 600 from pod rod 302, or rotation of pod 600 about an axis of pod rod 302 once pod rod 302 is attached to pod 600 as well as during operation of centrifuge 112. For example, as shown in the embodiment illustrated in FIG. 2A, pod rod aperture 601 and pod rod 302 may be oriented and configured so as to create a relatively stable configuration as described further below in reference to FIGS. 6B and 7.

In some examples of one disclosed embodiment illustrated in FIG. 3, pod rod 302 may be coupled to binary linkage 414 of dynamic positioning talon assembly 400. For example, as illustrated in FIG. 3, pod rod 302 may comprise a semi-circular channel 306 through configured to accept push-ball pin 304. Further, binary linkage 414 may include push-ball pin bore 420 extending through two parallel surfaces of binary linkage 414 and configured to accept push-ball pin 304. When pod rod 302 is properly inserted into binary linkage 414 such that semi-circular channel 306 is aligned with push-ball pin bore 420, pod rod 302 may be removably coupled to binary linkage 414 by inserting push-ball pin 304 through push-ball pin bore 420 of binary linkage 414 and semi-circular channel 306 of pod rod 302.

Figure 4A:
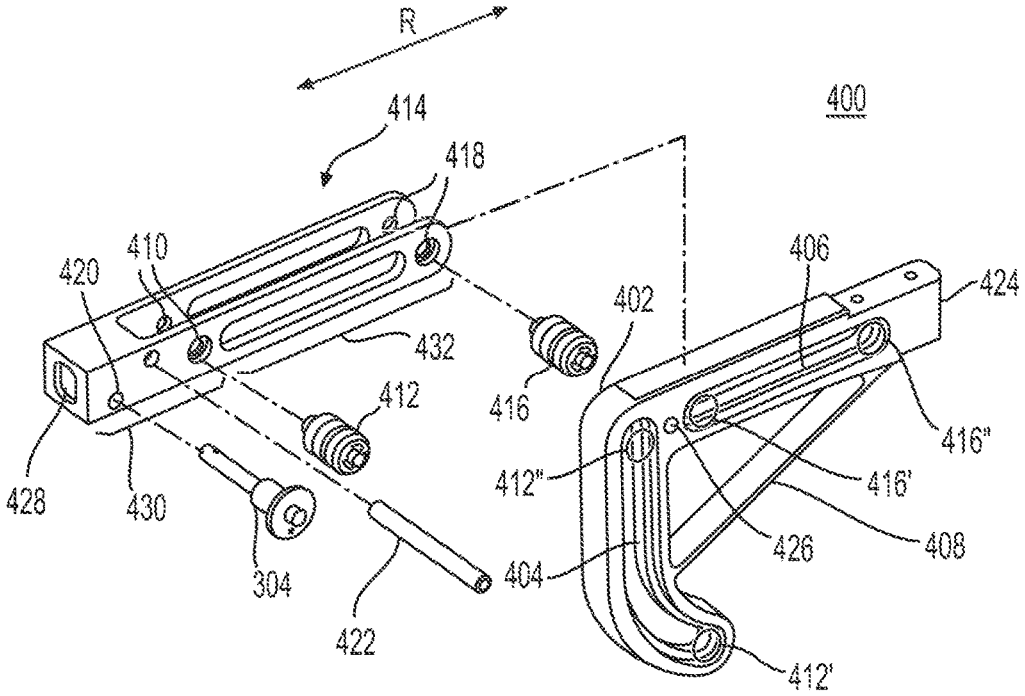
FIG. 4A is an exploded perspective illustration of a disclosed example of a dynamic positioning talon assembly that may be used with the centrifuge system of FIGS. 1A-B.

FIG. 4A is an exploded perspective view illustration of a dynamic positioning talon assembly 400 in accordance with some embodiments of the disclosure. The illustrated embodiment of a dynamic positioning talon assembly 400 comprises talon frame member 402, binary linkage 414, and at least two hinge pins 412 and 416.

Referring again to FIGS. 2B-2D, drive shaft 212 defines a vertical direction, an axial direction, and a radial direction. More particularly, drive shaft 212 extends along the vertical direction V out of motor 116. As illustrated in FIG. 2A, a plurality of dynamic positioning talon assemblies 400 may be fixably attached to an outer surface of drive shaft 212 such that a plurality of talon frame members 402 are distributed about the axial direction A of drive shaft 212. A surface 424 (shown in FIG. 4A) of each talon frame member 402 may be positioned proximate to drive shaft 212, held by the notched portion 222, and then attached using the alignment posts 427 that insert into the corresponding holes of the upper plate 218 and may extend therefrom along radial direction R. In the example embodiment illustrated in FIG. 2A, the plurality of talon frame members 402 are fixably attached to drive shaft 212 via a sandwich hub 216. More particularly, sandwich hub 216 is fixedly attached to an upper end of drive shaft 212. Surface 424 of each talon frame member 402 may be positioned proximate to a surface of sandwich hub 216 and may extend therefrom along radial direction R, and may be fixedly attached to drive shaft via sandwich hub 216, as also shown in the cross section of FIG. 2D.

A dynamic positioning talon assembly 400 comprises mechanical joints and structures configured to control and guide the movement of a pod 600 in response to rotational/inertial forces experienced as a result of the rotation of drive shaft 212 along axial direction A. In the example embodiment illustrated in FIG. 4A, talon frame member 402 of dynamic positioning talon assembly 400 may be a rigid member configured to include vertical guide slot 404, lateral guide slot 406, and fixed support linkage 408. Vertical guide slot 404 and lateral guide slot 406 form slot or guide portions of pin-in-slot joints that guide sliding movement of a pod assembly 300 along a planar path. In some examples, fixed support linkage 408 may provide additional structural support required to withstand forces experienced as a result of rotational/inertial forces.

Binary linkage 414 may be an elongated rigid member configured to connect pod assembly 300 to the drive shaft 212 of centrifuge 112. Binary linkage 414 further acts to physically and operationally link a plurality of slidable joints to control movement of pod assembly 300 in response to rotational/inertial forces. Binary linkage 414 may comprise a contiguous lower portion 430 and an upper portion 432.

In some embodiments, upper portion 432 of binary linkage 414 comprises elongated parallel members configured to be operably positioned and moveable on either side of talon frame member 402. Upper portion 432 of binary linkage 414 further comprises first hinge pin apertures 410 and second hinge pin apertures 418, each extending through parallel side members of binary linkage 414. First hinge pin apertures 410 may be located along upper portion 432 of binary linkage 414 proximate to lower portion 430 of binary linkage 414. Further, first hinge pin apertures 410 may be positioned on either side of vertical guide slot 404 and may be aligned with vertical guide slot 404, allowing first hinge pin 412 to be inserted therethrough, said first hinge pin 412 extending between each of first hinge pin apertures 410 on either side of vertical guide slot 404 to form a first pin-in-slot joint. More specifically, first hinge pin 412 may be fixably attached to each of first hinge pin apertures 410 and may be slidably movable between a bottom position 412' and an apex position 412" along a path defined by vertical guide slot 404 that allows the talon frame member 402 to extend greater than 90 degrees from the drive shaft, and preferably at least 93-95 degrees. Formation of a further extension to the top of the vertical guide slot 404 allows for the extension to greater than 90 degrees. Extending past 90 degrees allows for misalignment compensation to naturally occur. FIG. 4C illustrates an embodiment that aligns to only 90 degrees whereas FIG. 2D illustrates an embodiment that aligns to greater than 90 degrees due to the further extension of the top of the vertical guide slot 404. In some examples, vertical guide slot 404 may be curved, at least in part, including a logarithmic curve, a Fibonacci curve, and/or the like.

Similarly, second hinge pin apertures 418 may be located along upper portion 432 of binary linkage 414 distal to lower portion 430 of binary linkage 414 such that second hinge pin apertures 418 are positioned on either side of vertical guide slot 404 and aligned with lateral guide slot 406, allowing second hinge pin 416 to be inserted therethrough, said second hinge pin 416 extending between each of second hinge pin apertures 418 on either side of lateral guide slot 406 to form a second pin-in-slot joint. More specifically, second hinge pin 416 may be fixably attached to each of second hinge pin apertures 418 and may be slidably movable between a bottom position 416' and an apex position 416" along a path defined by lateral guide slot 406.

In some embodiments, binary linkage 414 may be moved to a position horizontal to lateral guide slot 406 such that position fixing hole 426 of talon frame member 402 aligns with an additional aperture on binary linkage 414 such that a pin 422 (shown in FIG. 4A) may be inserted to retain binary linkage 414 in an operating/rotating position. Advantageously, this configuration may be used to prevent binary linkage 414 from causing or experiencing potential damage when centrifuge 112 is operated without attaching a pod 600 to a particular binary linkage 414.

In some embodiments, lower portion 430 of binary linkage 414 may include a pod rod bore 428 positioned within lower portion 430 of binary linkage 414 and extending along the elongation thereof. Pod rod bore 428 may extend from an end surface of binary linkage 414 through at least some of the lower portion 430 of binary linkage 414. As illustrated in FIGS. 3 and 4A, pod rod bore 428 may be intersected by push-ball pin bore 420, which extends through parallel surfaces of binary linkage 414. Push-ball pin bore 420 and pod rod bore 428 may be positioned and configured such that pod rod 302 may be inserted into pod rod bore 428 such that channel 304 of pod rod 302 is aligned with push-ball pin bore 420 of binary linkage 414 (shown in FIG. 3), thereby allowing push-ball pin 304 to pass through push-ball pin bore 420 and channel 304, securing pod assembly 300 to dynamic positioning talon assembly 400 via pod rod 302.

As described above, pod assembly 300 and dynamic positioning talon assembly 400, including a vertical pin-in-slot joint and lateral pin-in-slot joint define a path along which pod 600 travels during operation of system 100, including minimum and maximum, or apex, positions of pod 600 along vertical direction V, and minimum and maximum position of pod 600 along radial direction R.

Figure 4B:
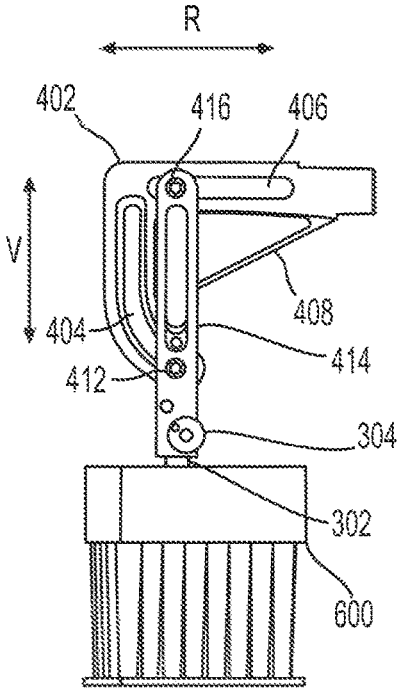
FIG. 4B is an isometric side view illustration of a disclosed example of a dynamic positioning talon assembly depicted in FIG. 4A and pod assembly depicted in FIG. 3, which may be used with the centrifuge of FIGS. 1A-B, in a loading/unloading position.
Figure 4C:
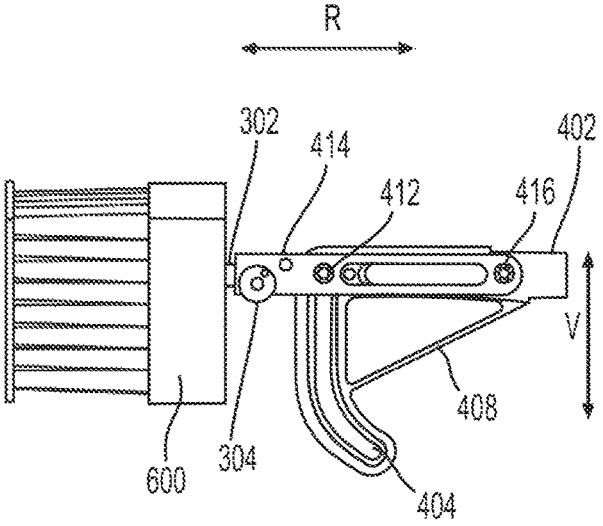
FIG. 4C is an isometric side view illustration of a disclosed example of a dynamic positioning talon assembly depicted in FIG. 4A and pod assembly depicted in FIG. 3, which may be used with the centrifuge of FIGS. 1A-B, in an operating/rotating position.

FIG. 4B is an isometric side-view illustration of a disclosed example of a dynamic positioning talon assembly 400 with pod assembly 300 in a loading/unloading position relative to talon frame member 402, which constitutes an initial and final position of pod 600 along both vertical direction V and along radial direction R. While drive shaft 212 of centrifuge 112 remains at rest, pod assembly 300 and binary linkage 414 may remain in the loading/unloading position illustrated in FIG. 4B with respect to talon frame member 402.

During operation of centrifuge 112, motor 116 imparts mechanical output force to rotate drive shaft 212 and components fixably attached to drive shaft 212, including sandwich hub 216, dynamic positioning talon assembly 400, and pod assembly 300. As discussed above in relation to FIG. 1A, control unit 118 may control various aspects of the operation of centrifuge 112 including, for example, a duration of operation and a maximum rotational speed of drive shaft 212. In some examples, centrifuge 112 may be configured to operate for a duration of between 20-60 seconds, and may be configured to rotate drive shaft 212 at maximum rotational speeds between 1,000-3,000 RPM.

FIG. 4C is an isometric side-view illustration of a disclosed example of a dynamic positioning talon assembly 400 with pod assembly 300 in an operating/rotating position relative to talon frame member 402, which constitutes an operating position of pod 600 along both vertical direction V and along radial direction R. In some embodiments, the operation of centrifuge 112 causes various components, including pod assembly 300 and binary linkage 414, to experience rotational forces, momentum, and inertia throughout the duration of the operation of centrifuge 112. The forces experienced by pod assembly 300 and other components necessarily increases as the rotational speed of drive shaft 212 increases. Advantageously, the rotational forces, angular momentum, and rotational inertia imparted on pod assembly 300 may cause pod assembly 300 and binary linkage 414 to travel along a path, rotating pod 600 into a horizontal operating/rotating position, thereby orienting pod 600, zoning funnels 606, article cone 308, and smokable herb 310 (shown in FIG. 3) into a horizontal orientation, thereby increasing compressive force on smokable herb 310 along the elongated direction of article cone 308.

The curved shape of the path traveled by pod 600 during operation of centrifuge 112 further increases the packing force applied to smokable herb 310 within article cone 308. More specifically, the curved shape of vertical guide slot 404 increases the packing force applied to smokable herb 310 as rotational and inertial force is further imparted along a second dimension as a result of the curved path taken by pod 600. Some advantages of disclosed embodiments include dynamic positioning of pod 600 during operation of centrifuge 112, which may allow for a substantial compressive force as pod assembly 300 moves from a vertical position to an angled position, while maintaining stability. More particularly, in some examples, a curved shape allows for a transition that is less abrupt than simply snapping from vertical to horizontal, which might otherwise displace and disrupt the packing operation, while maintaining a substantial compressive force that increases the ability of the packing operation of smokable herb within article cones, allowing for a more homogeneous packing, increased density, less air gaps, and/or the like.

In some examples, the rotational speed of centrifuge 112 may increase from 0-1,700 RPM, generating approximately 3,000 lbs. per square inch of compressive force on article cone 308 and smokable herb 310 within pod 600.

Figure 5A:
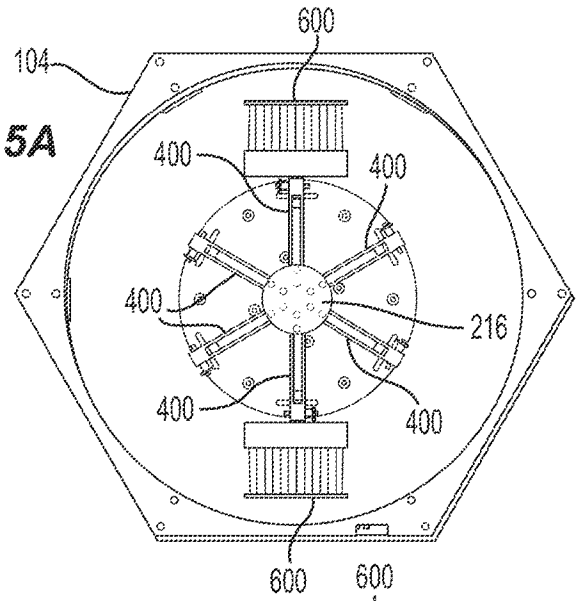
FIGS. 5A-D are plan-view illustrations of a disclosed example of pod arrangements that may be used with the centrifuge system depicted in FIGS. 1B and 2A.
Figure 5B:
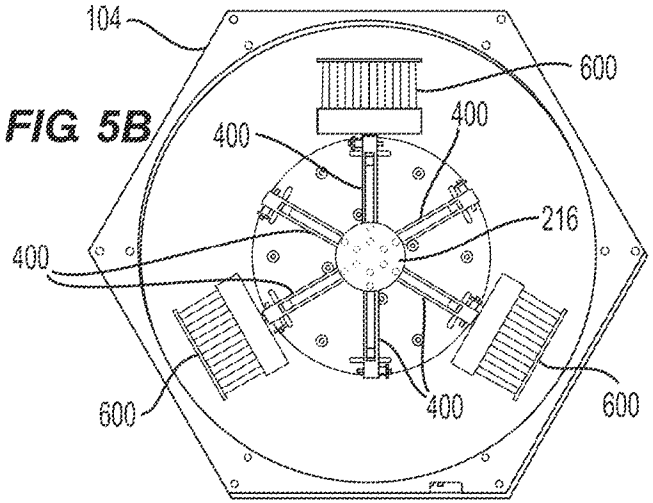
Figure 5C:
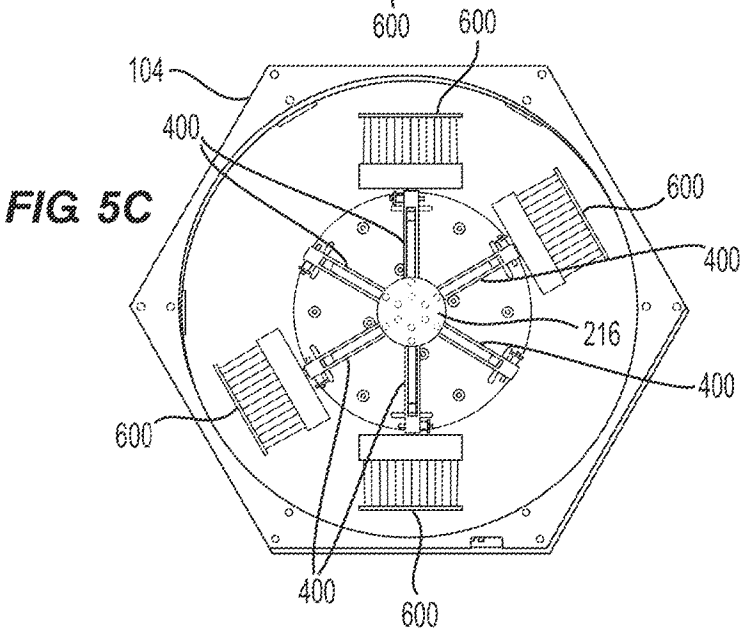
Figure 5D:
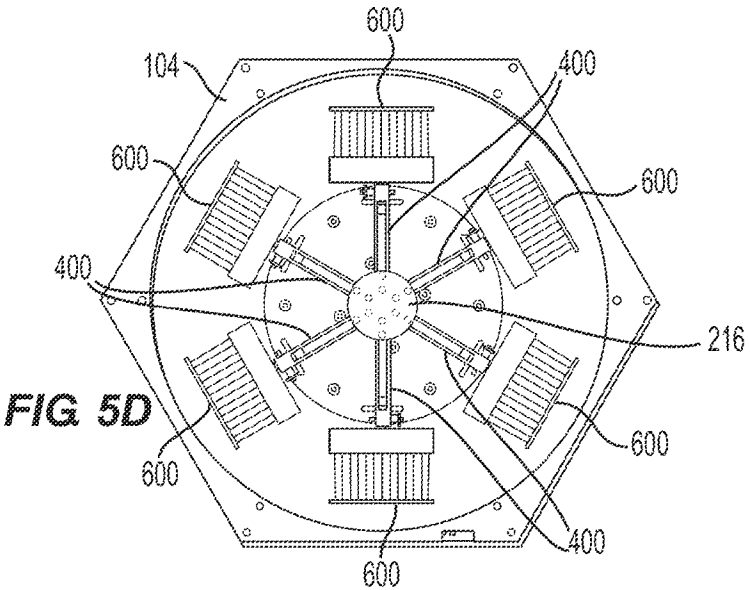

FIGS. 5A-FIG. 5D provide top-down illustrations of one disclosed example balanced pod configurations of a plurality of pods 600 within centrifuge 112. In FIG. 5A, for example, centrifuge 112 includes six dynamic positioning talon assemblies 400 and two pods 600. The two pods 600 may be evenly balanced within centrifuge 112 by attaching pods 600 to two opposing dynamic positioning talon assemblies 400. FIG. 5B illustrates a balanced configuration with three pods 600. FIG. 5C illustrates a balanced configuration with four pods 600. And FIG. 5D illustrates a balanced configuration with six pods 600. Other configurations may also be possible, for example if centrifuge 112 were configured to include a larger or smaller number of dynamic positioning talon assemblies 400 attached to drive shaft 212.

Figure 6B:
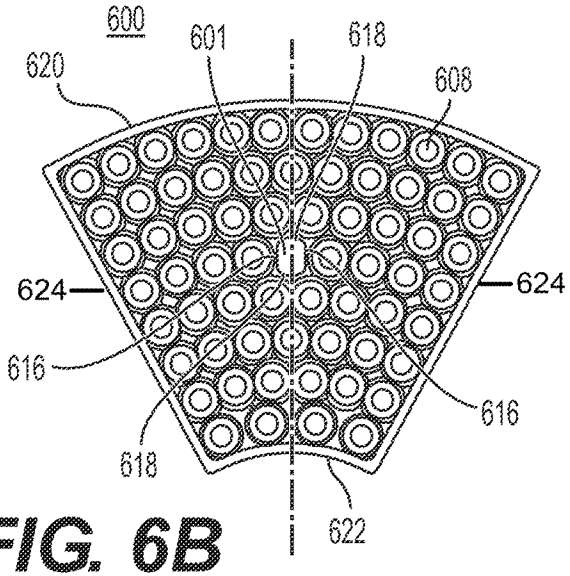
FIGS. 6A-D are multi-view illustrations of a disclosed example of a pod that may be used with the pod assembly depicted in FIG. 3.
Figure 6D:
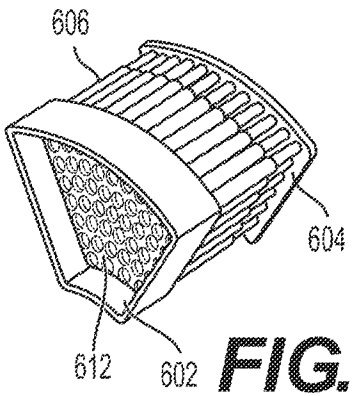
Figure 6A:
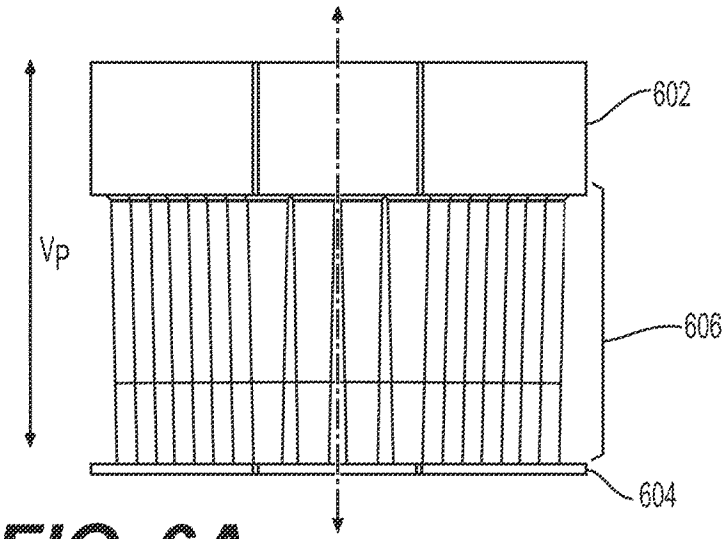
Figure 6C:
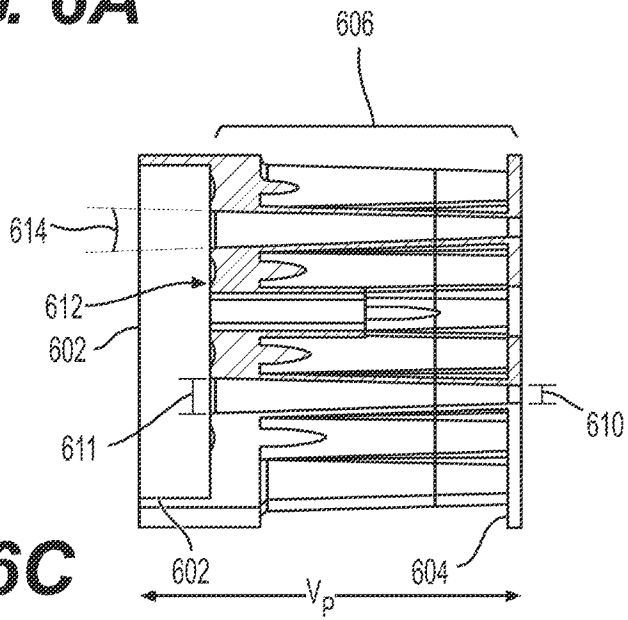

FIG. 6A is a profile view illustration of a disclosed example of a pod 600 that may be used with pod assembly 300. FIG. 6B is a top-down illustration of a disclosed example of a pod 600 that may be used with pod assembly 300. FIG. 6C is a cross-sectional illustration of a disclosed example of a pod 600 that may be used with pod assembly 300. FIG. 6D is an isometric illustration of a disclosed example of a pod 600 that may be used with pod assembly 300. In some embodiments, pod 600 includes a plurality of zoning funnels 606. In the example embodiment illustrated in FIGS. 6A-D, each pod 600 includes 66 zoning funnels 606. In some examples, each pod 600 includes more or less than 66 zoning funnels 606. In some examples, pods 600 with more or less than 66 zoning funnels 606 may have additional or less rows, respectively. Each zoning funnel 606 may include an annular upper opening 608 concentric to an annular lower opening 610. Upper opening 608 may be located proximate to an upper surface 612 of pod 600, and lower opening 610 may be located along bottom surface 604 of pod 600. In some embodiments, the diameter of upper opening 608 may be greater than the diameter of lower opening 610 such that zoning funnels 606 form a conical shape tapering from upper opening 608 to lower opening 610. In some embodiments, the angle of zoning funnel 606 is between 0.5-3.5 degrees. Further, in some embodiments, the diameter of upper opening 608 is approximately 0.5 inches, and the diameter of lower opening 610 is approximately 0.25 inches. In some examples, pod 600 includes a pod rod aperture 601 including a hole located near the center of pod 600 extending vertically from upper surface 612 through bottom surface 604.

Advantageously, pod 600 may be comprised of materials designed to prevent wrinkling, deformation, or tearing of article cone 308 during operation of centrifuge 112 due to compressive force exerted on article cone 308 and smokable herb 310 during loading of article cones 308 within zoning funnels 606, loading of smokable herb 310 within article cones 308, during a packing operation, and during removal of ready-made smokable products from zoning funnels 606. In some examples, pod 600 may be composed of nylon-based cellular matrix, which are non-stick and poreless. Further, the tapered shape and size of zoning funnels 606 within the disclosed example embodiment are configured to allow a wide variety of article cone shapes and sizes.

Additionally, the shape of pod rod 302 and pod rod aperture 601 may be configured to ensure that pod rod 302 is correctly oriented within pod 600 such that pod 600 is properly aligned and oriented upon coupling to binary linkage 414. As illustrated, for example in FIGS. 6B and 7, pod rod aperture 601 includes two substantially flat parallel surfaces 616 and two curved parallel surfaces 618 adjacent to the flat parallel surfaces 616. Similarly, pod rod 302 may include two substantially flat parallel surfaces and two curved parallel surfaces adjacent to the flat parallel surfaces. Tolerances between size of pod rod 302 and size of pod rod aperture 601 may be within a range such as to reduce or eliminate excessive vibration, unintentional release or movement of pod 600 from pod rod 302, or rotation of pod 600 about an axis of pod rod 302 during operation of centrifuge 112, while also allowing intentional removal of pod rod 302 from pod rod aperture 601 without significant effort.

In some embodiments, the perimeter of pod 600 includes an outer semicircular surface 620, an inner semicircular surface 622, and two side surfaces 624, wherein outer semicircular surface 620 and inner semicircular surface 622 form semicircular portions of concentric circles. While multiple different pod 600 shapes may be used, the illustrated perimeter shape of pod 600 is configured such that a plurality of pods 600 may be positioned together alongside surfaces 624 to form a concentric ring around centrifuge 112, which are each attachable to dynamic positioning talon assemblies 400 via pod rods 302 as illustrated in FIGS. 3, 4B, and 4C in order to optimize the space within centrifuge 112 while pods 600 are in a loading/unloading position.

Pod 600 may further include a tray 602 forming a wall extending along the entire perimeter of pod 600 and extending along a vertical direction Vp from upper surface 612 a sufficient height to contain smokable herb 310 being spread and distributed over upper surface 612 of pod 600 in order to evenly deposit the smokable herb 310 into the plurality of article cones 308 disposed within zoning funnels 606 of pod 600.

Each pod 600 may include a removable housing lid that may be removably fastened to pod 600 above upper surface 612 of pod 600 in order to prevent airflow within the housing during operation of centrifuge 112 from disrupting the distribution of smokable herb deposited into each zoning funnel 606.

Figure 7:
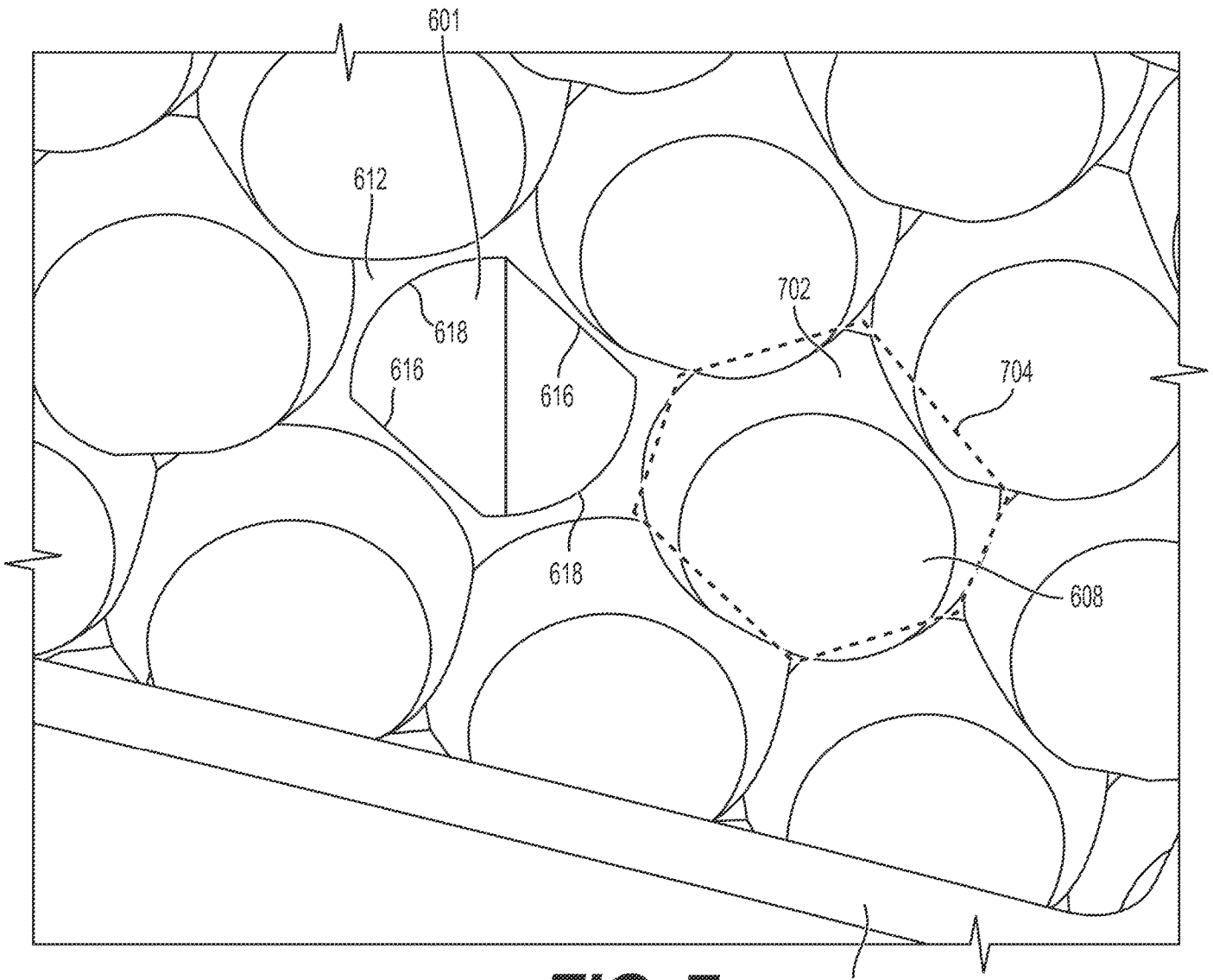
FIG. 7 is a close-up perspective illustration of an upper surface of the pod depicted in FIGS. 6A-D including a zoning funnel arrangement and pod rod aperture.

FIG. 7 is a close-up perspective illustration of one disclosed example of upper surface 612 of pod 600 illustrated in FIGS. 6C and 6D. According to one or more embodiments, pod 600 may include an upper surface 612 disposed directly above the plurality of zoning funnels 606, being configured to provide an interface for distributing smokable herb 310 into article cones 308 within zoning funnels 606. In some examples, upper surface 612 may include a plurality of hexagonal openings 604 with a lower end 602 being substantially circular, the lower end 602 being directly aligned with the top part of zoning funnels 606. The upper end of hexagonal opening 604 may be concentric to zoning funnels 606 and may have a diameter larger than upper opening 608. Further, the slope of each opening 602 may be less than that of the taper throughout the length of zoning funnels 606. According to some embodiments, each curve, or slice of opening 602 may be parabolic in shape. Further, the perimeter of each upper end of opening 602 may be configured to overlap with adjacent openings 602 thereby forming an upper edge of zoning funnels 606 such that lateral surfaces of upper surface 612 are reduced or eliminated, resulting in improved funneling of smokable herb 310 into article cone 308 within each zoning funnel 606.

As discussed previously, pod rod aperture 601 may extend vertically from an upper surface 612 of pod 600 to a bottom surface 604 of pod 600. In some examples of one disclosed embodiment illustrated in FIG. 7, pod rod aperture 601 comprises an opening formed by two substantially flat parallel surfaces 616, and two curved parallel surfaces 618 adjacent to the flat parallel surfaces 616.

Some advantages of the disclosed embodiments include increased accuracy for funneling smokable herb 310 into article cones 308 within each zoning funnel 706. The curved shape allows for less waste, increased accuracy of measurement, and stability of operation of the centrifuge 112.

Figure 8:
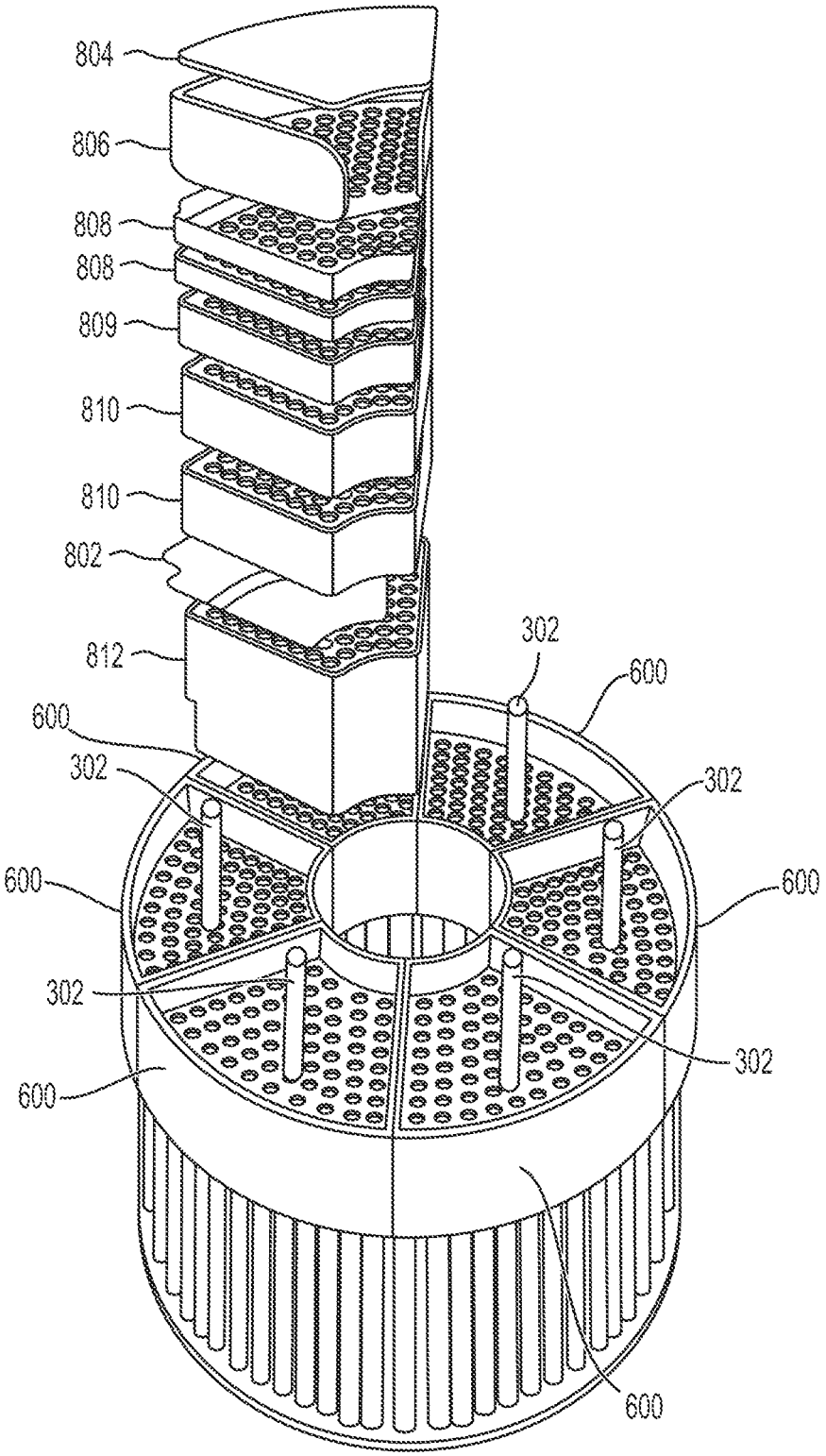
FIG. 8 is a perspective illustration of a disclosed example of a modular measuring and filling apparatus that may be used in conjunction with the pod assembly depicted in FIG. 3.

FIG. 8 is a perspective illustration of one disclosed example of a modular measuring and filling apparatus that may be used in conjunction with the pod 600 of FIGS. 6A-D. A plurality of measuring trays and funnels may be used to measure precise amounts of smokable herb 310, and to fill article cones 308 disposed within zoning funnels 606 of a pod 600 with a pre-measured quantity of smokable herb 310 to be packed into ready-made smokable products.

In some embodiments, a specified weight of herb may be deposited into one or more of measuring trays 808, 809, and 810 which may be stacked vertically until the predetermined weight of smokable herb 310 is flush with an upper surface of an uppermost measuring tray. Advantageously, measuring trays 808, 809, and 810 may have different thicknesses, and therefore hold different amounts of smokable herb 310. In some examples, measuring tray 808 may be 0.75" thick, while measuring tray 809 is 1.5" thick, and measuring tray 810 is 3" thick. Thus, measuring trays may be combined in various combinations to determine a precise configuration of measuring trays that are equivalent to a given weight of smokable herb 310. In some embodiments, filling tray 806 may be utilized to guide and fill stacked filling trays with smokable herb 310.

In some embodiments, plate 802 may be used to retain smokable herb 310 being deposited within a given configuration of measuring trays and may be inserted between a pod loading funnel 812 and a bottom most measuring tray of the given configuration of measuring trays. In some examples, measuring trays 808, 809, and 810, may include magnets located between each measuring tray, hook-and-loop fasteners, or another readily appreciated method for removably attaching two or more trays together such that apertures of each measuring tray are aligned with each other.

The openings of each tray may be aligned such that when plate 802 is removed from below a measuring tray configuration filled with smokable herb 310, the pre-measured quantity of smokable herb 310 is automatically deposited through pod loading funnel 812 into each appropriate zoning funnel 606.

Once a plurality of pods 600 are removably attached to binary linkages 414 (illustrated in FIG. 4) in a balanced configuration via pod rods 302, removable housing lid 108 of system 100 is slidably closed and locked at which point, a controller accepts input and commences operation of system 100. Removable housing lid 108 automatically unlocks once pods 600 are no longer moving and pods can be removed. Ready-made smokable products including article cones 308 filled with packed smokable herb 310 may be extracted from zoning funnels 606 of a pod 600 by applying a level of force sufficient to dislodge article cones 308 from the zoning funnels 606 without damaging the article cones 308. For example, a rubber mallet may be used to tap a bottom surface 604 of pod 600 with enough force to dislodge each article cone 308. By way of another example, a tool may be used to impart force to each article cone. In some embodiments, the tool may comprise a plurality of rods extending along a vertical direction Vp from a base surface, each rod having a diameter less than the diameter of lower opening 610, said rods being arranged so as to align with each of the zoning funnels 606 of pod 600. In some examples, when a pod 600 is properly aligned with the rods of said tool such that a rod of the tool extends through each lower opening 610, a dislodging force may be applied to article cones 308 gradually.

INDUSTRIAL APPLICABILITY

The disclosed system may be applicable to the *cannabis* industry, where ready-made smokable products are in demand, and thus where the ability to accurately and efficiently measure, pack, and prepare commercial quantities of ready-made smokable products can affect profitability and efficiency. The disclosed system may be able to efficiently, accurately, and consistently measure a specified volume and/or weight of smokable herb 310 to be deposited into a one or more article cones 308. The disclosed system may then be used to pack and prepare commercial quantities of ready-made smokable products. Operation of modular smokable-product packaging centrifuge system 100 and modular measuring and filling apparatus 800 with reference to process 900 illustrated in FIG. 9.

Figure 9:
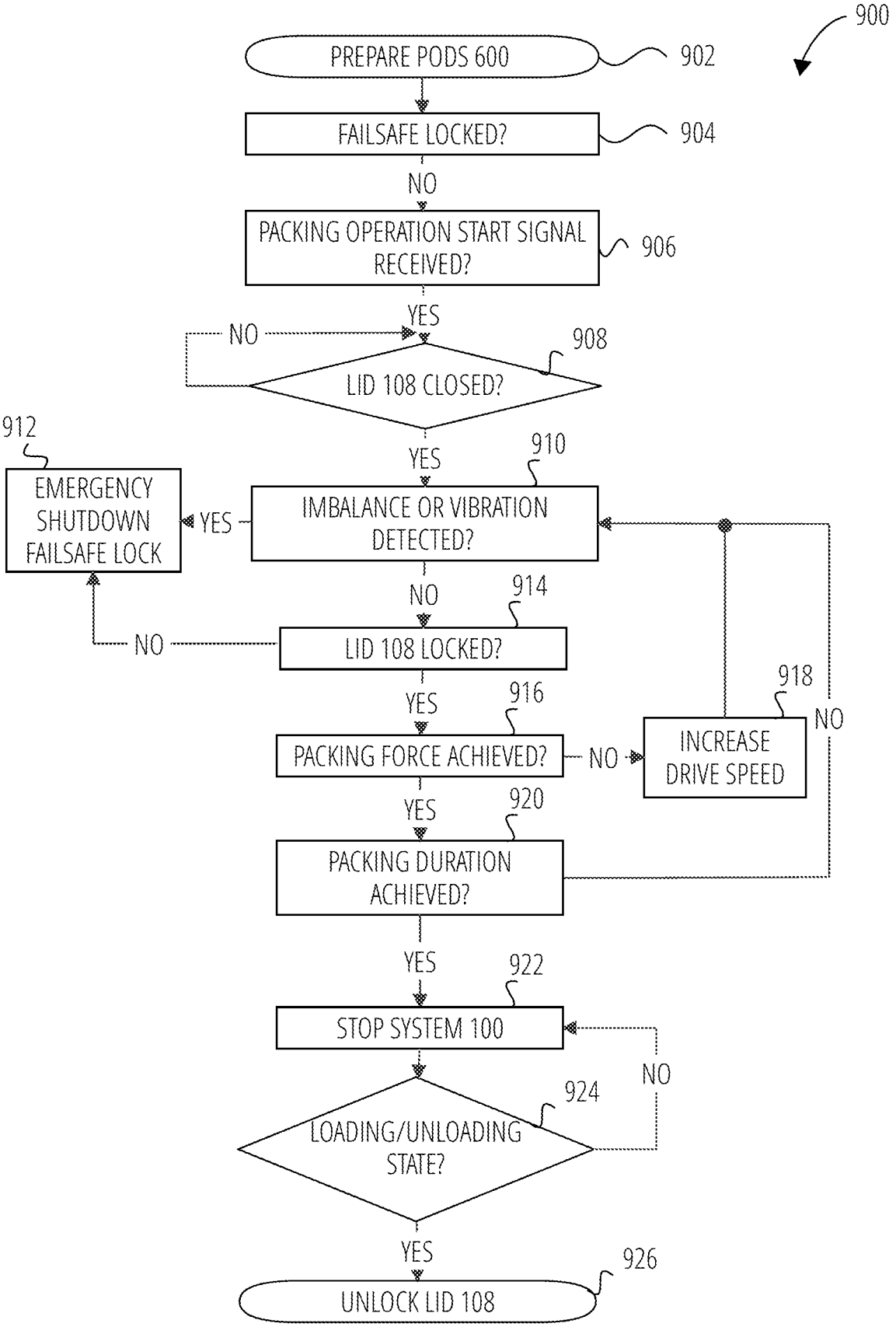
FIG. 9 is a flowchart depicting a disclosed example of a method that may be performed by the system of FIGS. 1A-B.

As shown in FIG. 9, process 900 may begin with preparation of a plurality of pods 600 (Step 902). In some embodiments modular measuring and filling apparatus 800 may be used to measure an appropriate volume and/or weight of smokable herb 310, and to fill a plurality of article cones 308 disposed within the zoning funnels 606 of each pod 600 as disclosed above with respect to FIG. 8). A balanced number of pods 600, (e.g., corresponding to one of the configurations disclosed above with respect to FIGS. 5A-5D), may be prepared with substantially equal or nearly equal quantities of smokable herb 310 in an equal number of article cones 308. Assuming that removable housing lid 108 begins in from an unlocked and open state, each pod 600 may be attached to a binary linkage 414 within modular smokable-product packaging centrifuge system 100 as described above with reference to FIG. 3. In some embodiments, Step 902 further comprises loading the smokable herb into the plurality of article cones 308 by stacking one or more measuring trays to align with a height of the plurality of article cones 308, or corresponding to a desired volume or weight of smokable herb 310 to be used in preparing each ready-made smokable product, depositing the smokable herb into the one or more measuring trays, and depositing the smokable herb 310 into respective zoning funnels 606 of the plurality of pods 600 by removing a removable plate above the plurality of pod assemblies. In some examples, the measuring trays correspond with measuring trays 806, 808, and 810, and the removable plate corresponds with plate 802.

During Step 904, prior to receiving any commands or performing further operations, a failsafe lock must be disengaged. The failsafe lock engages in response to operational errors of system 100 and must be reconfigured to enable any further actions or commands. Failsafe lock may be, for example, a software switch requiring a PIN or passcode to unlock the device, or may be a hardware trigger such as a switch or fuse configured to disable system 100 entirely, or to limit system 100 to simply displaying an error message to confirm that the system has been disabled. The system may be configured to be reenabled only by authorized and/or trained users familiar in possession of the necessary codes, keys, or knowledgeable regarding the location of the failsafe lock. The purpose of the failsafe lock may be to prevent unauthorized and/or improper use of system 100.

Assuming the failsafe lock is disengaged, control unit 118 may be configured to receive input initiating a packing operation of system 100 (Step 906). In some examples, the input received may be provided manually or automatically and may be provided either locally or remotely as described above in reference to FIG. 1. In addition to receiving a signal instructing control unit 118 to commence a packing operation, control unit may be further configured to accept or collect additional information pertinent to the desired packing operation. In some examples, control unit 118 may be configured to receive information such as the number of pods in a configuration, a desired density of a resulting packing operation, a desired maximum amount of sustained or peak force, or a duration of a packing operation. In some examples, Steps 904-926 may be implemented by the control unit 118 alone, or on one or more servers such as servers discussed above with respect to FIG. 1. In some examples, not all of the illustrated Steps may be performed in all aspects of process 900. Additionally, one or more processes not expressly illustrated in FIG. 9 may be included before, after, in between, or as part of Steps 902-926. In some aspects, one or more Steps 904-926 may be implemented, at least in part, in the form of executable code stored on non-transitory, tangible, computer readable media that when run by one or more processors (e.g., a processor of the control unit 118) may cause the one or more processors to perform one or more of Steps 904-926.

During Step 908, control unit 118 may monitor input from sensors as disclosed above in reference to FIG. 2A to determine whether removable housing lid 108 is in a closed position. In Step 910, control unit 118 may collect information regarding the configuration of pods 600 attached to binary linkages 414 within the system. In Step 910, control unit 118 may collect the information based either on manual input or by monitoring sensors to determine weight distribution of pods 600 within system 100. Using the information collected or received, control unit 118 may evaluate the weight distribution of pods 600 to determine whether system 100 will remain balanced during a packing operation of system 100. In some examples, when an imbalance is detected while removable housing lid 108 is in the closed position, control unit 118 may trigger a failsafe lock in Step 912 in order to prevent unauthorized or improper use of system 100 in order to prevent personnel and/or property damage. Alternatively, system 100 may not monitor or require information regarding the balance of pods 600 within system 100 prior to commencing with Step 914.

In the event that control unit 118 does not detect an imbalance of pods 600 within system 100, control unit 118 may proceed to Step 914 in which it may monitor sensors within system 100 to determine whether removable housing lid 108 is locked. In the event that removable housing lid 108 is not locked, control unit 118 may send a signal to engage a locking mechanism to lock removable housing lid 108 in a closed position substantially covering cabinet 134 as disclosed above with respect to FIGS. 1 and 2A. In some examples, upon determining that removable housing lid 108 is locked, control unit 118 may initiate a packing operation as part of Step 914.

During Step 914, control unit 118 may control motor 116 coupled to drive shaft 212, the drive shaft 212 extending along a vertical direction V out of motor 116 and coupled to a sandwich hub 216, the sandwich hub 216 being coupled to a plurality of talon frame members 402. The drive shaft may be rotated in an axial direction A in response to the motor being initiated, causing the sandwich hub and the plurality of talon frame members to rotate along an axial direction A. Throughout the packing operation of system 100, the plurality of pod assemblies 300 may be caused to travel from a first position to a second position along a path defined by a respective guide slot of each respective talon frame member in response to the axial rotation of the plurality of talon frame members as further shown and discussed above with respect to FIGS. 4B and 4C.

During Step 916, control unit 118 may determine whether system 100 has achieved a desired maximum packing force on pods 600. In some embodiments, maximum packing force may be determined by monitoring the speed of motor 116 or by monitoring pressure sensors configured to generate signals indicative of an amount of pressure imparted to each pod 600. In the event the desired maximum packing force has not yet been achieved, control unit 118 may increase the output speed of motor 116 in order to achieve the desired maximum packing force on pods 600 (Step 918). In some examples, speed of motor 116 may be adjusted during operation or during subsequent runs. Desired maximum packing force may be, for example, a maximum impulse of packing force, an average packing force over a specified period of time, or a level of packing force maintained for a pre-determined amount of time.

During Step 920, control unit 118 may monitor the period, or the duration of a packing operation. The period or duration of a packing operation may be determined, in some examples, as either an amount of time since the start of motor 116, or alternatively as an amount of time since the desired packing force was achieved in Step 916. Until the predetermined maximum packing force has been achieved and the predetermined packing duration has expired, control unit 118 may continue to drive motor 116, and may return to Step 910 to detect unsafe or undesirable packing operation parameters. For example, in some embodiments where control unit 118 detects excessive vibrations or where control unit 118 determines that removable housing lid 108 is not in a locked state, motor 116 may be disengaged in response to a fail-safe protocol (Step 912). In some examples, the sensors may determine the vibration exceeds a threshold (e.g., 50-100 Hz) and cease operation in response to the determination that the vibration exceeds a predetermined threshold.

In Step 922, upon successfully operating for a predetermined period of time, control unit 118 may disengage motor 116 such that the plurality of pod assemblies 300 return to a loading/unloading position. In some examples, the predetermined amount of time may be 20-60 seconds, or may be variable depending on properties of the smokable herb. In some examples, the motor may be disengaged in response to a fail-safe protocol, such as detecting vibration from sensors within the centrifuge. In some examples, the sensors may determine the vibration exceeds a threshold (e.g., 50-100 Hz) and cease operation in response to the determination that the vibration exceeds the threshold.

In Step 924, control unit 118 may monitor motor 116 and pod assemblies 300 to confirm that pod assemblies 300 have returned to a loading/unloading position or state such that motor 116 is no longer rotating along an axial direction A. Upon determining that pod assemblies 300 have reached a loading/unloading position or state, control unit 118 may unlock removable housing lid 108 thereby allowing access to pod assemblies 300 and the ready-made smokable products.

Figure 10:
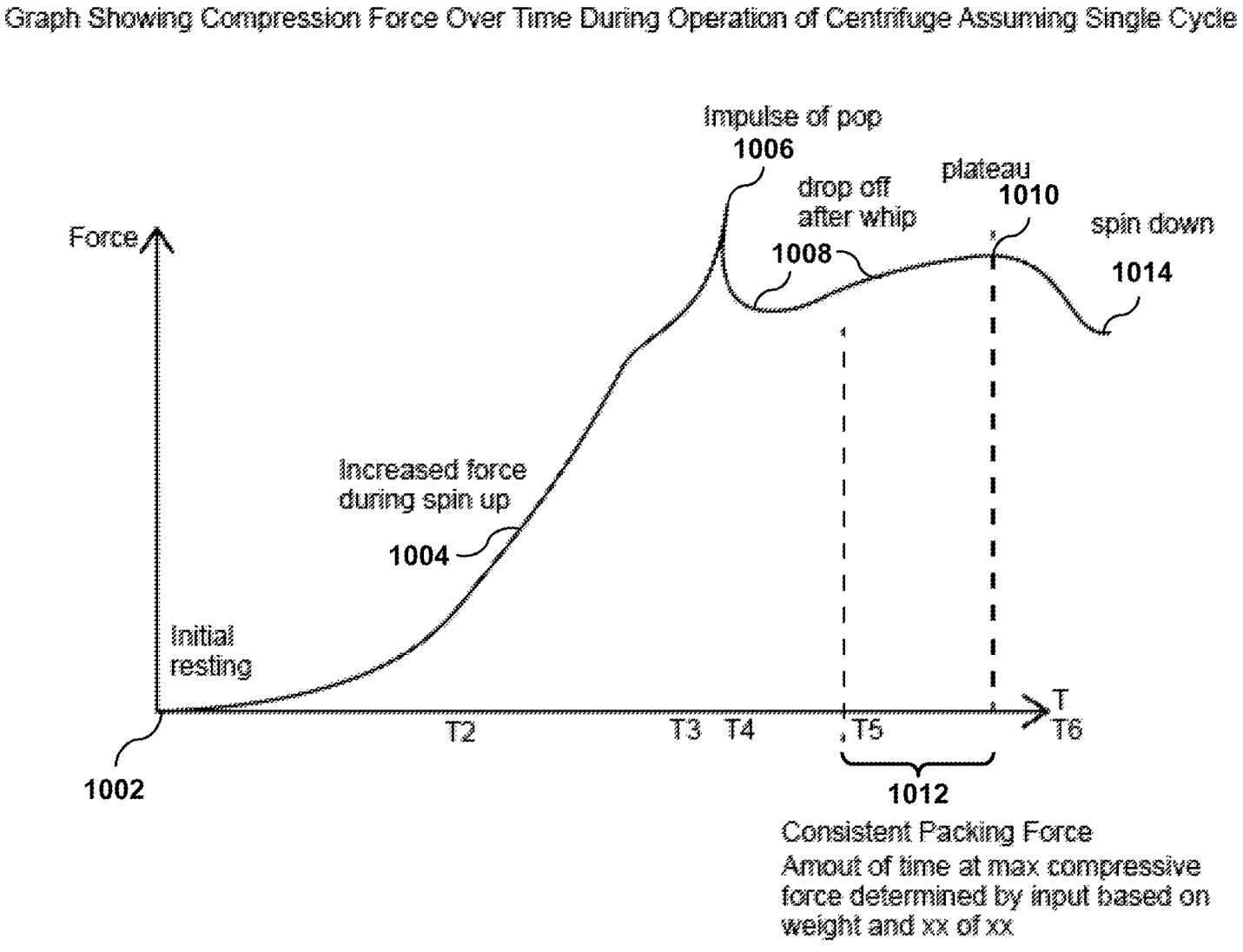
FIG. 10 is a graph illustrating a disclosed example showing force as a function of time inside a pod as depicted in FIGS. 6A-D, demonstrating the compressive forces imparted to smokable herb within the pod during operation of the centrifuge system depicted in FIGS. 2A-D.

FIG. 10 is a graph illustrating a disclosed example showing force as a function of time inside a pod as depicted in FIGS. 6A-D, demonstrating the compressive forces imparted to smokable herb within the pod during operation of system 100.

In some embodiments, at a time T1 (1002), motor 116 of modular smokable-product packaging centrifuge system 100 initiates rotation of pod assemblies 300 and begins at a resting position where force imparted to pod assemblies 300 by system 100 is zero.

In some embodiments, at a time T2 (1004), increased rotational force begins to cause pod assemblies 300 to experience increasing rotational forces. As rotational and inertial forces on pod assemblies 300 increase, pod assemblies 300 begin to travel from a loading/unloading position (depicted in FIG. 4B), to an operating/rotating position (depicted in FIG. 4C).

In some embodiments, at a time T3 (1006), the increased rotational force causes pod assemblies 300 to reach an operating/rotating position (depicted in FIG. 4C). Pod assemblies 300 reach an operating/rotating position that is substantially normal to the vertical direction V before motor 116 reaches a maximum desired rotational velocity. As a result, pod assemblies 300 experience an added impulse of compressive force as their upward movement along the vertical direction V is limited by the vertical guide slot 404 of dynamic positioning talon 400, shown in FIG. 10 as an impulse force.

In some embodiments, at a time T4 (1008), overall force imparted to pod assemblies 300 decreases slightly following the impulse experienced as pod assemblies reach an operating/rotating position.

In some embodiments, at a time T5 (1008), motor 116 of modular smokable-product packaging centrifuge system 100 reaches and maintains its desired maximum speed and packing force for the duration of a packing operation.

In some embodiments, at a time T6 (1010), following the predetermined packing operation period of time, motor 116 of modular smokable-product packaging centrifuge system 100 is turned off. As a result, the packing force experienced by pod assemblies 300 due to a packing operation decreases steadily to zero as pod assemblies return to their loading/unloading positions.

In the foregoing description, specific details are set forth describing some aspects consistent with the present disclosure. The specific aspects disclosed herein are meant to be illustrative, but not limiting. Phrases including "such as" and "for example" are intended to be non-exclusive, and not limit aspects to the set of things listed within those phrases. One skilled in the art may realize other elements that, although not specifically described here, are within the scope and the spirit of this disclosure. In addition, to avoid unnecessary repetition, one or more features shown and described in association with one example may be incorporated into other examples unless specifically described otherwise or if the one or more features would make an example non-functional. It will be apparent to those skilled in the art that various modifications and variations can be made to the disclosed system. Other embodiments will be apparent to those skilled in the art from consideration of the specification and practice of the disclosed system. It is intended that the specification and examples be considered as exemplary only, with a true scope being indicated by the following claims and their equivalents.

What is claimed is:

1. A modular centrifuge system for preparing and packing ready-made smokable herb products, comprising:

a drive assembly comprising:

a motor;

a drive shaft rotatably coupled to the motor, the drive shaft defining a vertical direction, an axial direction, and a radial direction, the drive shaft extending along the vertical direction out of the motor; and a sandwich hub coupled to the drive shaft, wherein the sandwich hub includes an upper plate and a portion with a plurality of notched surfaces;

wherein initiation of the motor rotates the drive shaft assembly along the axial direction; and a plurality of dynamic positioning talon assemblies, each dynamic positioning talon assembly comprising a talon frame member and a binary linkage, the talon frame member abutting one of the plurality of notched surfaces of the portion of the sandwich hub and including at least one guide slot and at least one alignment post and being fixedly attached to the sandwich hub using the at least one alignment post and the upper plate and extending outwardly therefrom along the radial direction, the binary linkage being slidably coupled to the at least one guide slot of the talon frame member and being configured to move from a first position to a second position along a path defined by the at least one guide slot wherein said path extends greater than 90 degrees to the drive shaft; and a plurality of pod assemblies, each pod assembly comprising a pod including a plurality of zoning funnels, each of the plurality of pod assemblies being detachably coupled to a respective binary linkage;

wherein each pod is configured to move from the first position to the second position along the path defined by the at least one guide slot in response to rotational movement of the drive assembly in the axial direction.

2. The modular centrifuge system of claim 1, further comprising a housing configured to enclose substantially all of the drive shaft, sandwich hub, dynamic positioning talon assemblies and pod assemblies during operation of the modular centrifuge system, the housing comprising:

a fixed housing wall, a fixed housing base, and a removable housing lid, wherein the housing wall comprises an inner wall that extends along the radial direction and an outer wall oblique to the inner wall, wherein the radius of the inner wall is greater than a radius of the pod assemblies in the second position.

3. The modular centrifuge system of claim 2, wherein the removable housing lid is slidably attached to a carriage assembly disposed along substantially parallel surfaces of the outer wall and configured to slide in a lateral direction along a path defined by the carriage assembly from a first position wherein removable housing lid substantially covers the entire lateral area formed by the upper edge of the outer wall to a second position.

4. The modular centrifuge system of claim 1, wherein the path defined by the vertical guide slot extends along an arc in the radial direction wherein the radius of second position is greater than the radius of the first position, and wherein the vertical height of the second position is greater than the vertical height of the first position.

5. The modular centrifuge system of claim 1, wherein the arc of the path defined by the vertical guide slot is an exponential curve.

6. The modular centrifuge system of claim 1, wherein the arc of the path defined by the vertical guide slot is a Fibonacci curve.

7. The modular centrifuge system of claim 1, wherein one or more of the plurality of zoning funnels include an opening diameter greater than a lower closing diameter.

8. A system for preparing and packing ready-made smokable herb products comprising:

a control unit coupled to a centrifuge, the centrifuge comprising:

a drive assembly comprising:

a motor;

a drive shaft rotatably coupled to the motor, the drive shaft defining a vertical direction, an axial direction, and a radial direction, the drive shaft extending along the vertical direction out of the motor; and a sandwich hub coupled to the drive shaft, wherein the sandwich hub includes an upper plate and a portion with a plurality of notched surfaces;

wherein initiation of the motor rotates the drive shaft assembly along the axial direction; and a plurality of dynamic positioning talon assemblies, each dynamic positioning talon assembly comprising a talon frame member and a binary linkage, the talon frame member abutting one of the plurality of notched surfaces of the portion of the sandwich hub and including at least one guide slot and at least one alignment post and being fixedly attached to the sandwich hub using the at least one alignment post and the upper plate and extending outwardly therefrom along the radial direction, the binary linkage being slidably coupled to the at least one guide slot of the talon frame member and being configured to move from a first position to a second position along a path defined by the at least one guide slot wherein said path extends greater than 90 degrees to the drive shaft; and a plurality of pod assemblies, each pod assembly comprising a pod including a plurality of zoning funnels, each of the plurality of pod assemblies being detachably coupled to a respective binary linkage;

wherein each pod is configured to move from the first position to the second position along the path defined by the at least one guide slot in response to rotational movement of the drive assembly in the axial direction;

the control unit being configured to:

initiate the motor coupled to the drive shaft causing the drive shaft to rotate along the axial direction;

monitor via sensors within the centrifuge, the rotational speed of the drive shaft; and disengage the motor coupled to the drive shaft.

9. The system of claim 8, the control unit being further configured to:

monitor vibration via the sensors;

determine vibration exceeds a threshold; and cease operation of the motor in response to the determination that the vibration exceeds the threshold.

10. The system of claim 8, wherein the control unit is configured to operate the centrifuge remotely.

11. The system of claim 8, wherein the motor is configured to operate for a duration of between 20-60 seconds.

12. The system of claim 8, wherein the pod assembly is able to rotate at rotational speeds between 1,000-3,000 RPM.

13. The system of claim 8, the control unit being further configured to determine the plurality of pod assemblies have moved from the first position to the second position along the path defined by the at least one guide slot.

14. The system of claim 8 wherein each of the plurality of talon frame members include two alignment posts.

* * * * *